US012758045B2

(12) United States Patent
Farah Bakhsh et al.

(10) Patent No.: US 12,758,045 B2
(45) Date of Patent: Oct. 13, 2026

(54) AUTOMATIC APPARATUS AND METHOD FOR CHANGING A DIAPER

(71) Applicants: Iman Farah Bakhsh, Cape Girardeau, MO (US); Marzieh Abbasi, Cape Girardeau, MO (US)

(72) Inventors: Iman Farah Bakhsh, Cape Girardeau, MO (US); Marzieh Abbasi, Cape Girardeau, MO (US)

( * ) Notice: Subject to any disclaimer, the term of this patent is extended or adjusted under 35 U.S.C. 154(b) by 68 days.

(21) Appl. No.: 18/919,821

(22) Filed: Oct. 18, 2024

(65) Prior Publication Data

US 2026/0108091 A1 Apr. 23, 2026

(51) Int. Cl.

| | |
|---|---|
| ***A47G 25/90*** | (2006.01) |
| ***A47D 5/00*** | (2006.01) |
| ***A47D 15/00*** | (2006.01) |

(52) U.S. Cl.

CPC ..... *A47G 25/90* (2013.01); *A47D 5/00* (2013.01); *A47D 15/005* (2013.01)

(58) Field of Classification Search

CPC ..... A47G 25/90; A47G 5/00; A47D 15/005
See application file for complete search history.

(56) References Cited

U.S. PATENT DOCUMENTS

| | | | | |
|---|---|---|---|---|
| 1,252,751 A * | 1/1918 | Weatherford | A61G 5/10 | 4/444 |
| 2,631,301 A * | 3/1953 | Hyland | A47D 15/008 | 5/604 |
| 3,306,287 A * | 2/1967 | Arp | A61B 6/0421 | 5/608 |
| 4,205,669 A * | 6/1980 | Hamann | A61F 5/3769 | 5/621 |
| 9,102,467 B2 * | 8/2015 | Chomik | B65F 1/1405 | |
| 10,034,582 B2 | 7/2018 | Farahbakhsh | | |

(Continued)

FOREIGN PATENT DOCUMENTS

| | | | |
|---|---|---|---|
| CN | 2613195 Y | * | 4/2004 |
| CN | 107019607 A | * | 8/2017 |

(Continued)

OTHER PUBLICATIONS

Translation JP 2011011028.*

(Continued)

*Primary Examiner* — Shaun R Hurley
(74) *Attorney, Agent, or Firm* — NovoTechIP International PLLC

(57) ABSTRACT

An apparatus and method for replacing a used diaper, including a frame, a backrest and a core movable in the frame. The method includes placing a new diaper onto a diapering system on the core, placing the person on the backrest, moving the core from an initial position to a first position adjacent the diapering area, removing the used diaper using a diaper removing system, depositing the used diaper into a waste tank by the diaper removing system of the core, moving a diapering system of the core into a position adjacent the diapering area, placing the new diaper, held by the diapering system, onto the diapering area, and moving the core back to the initial position after the new diaper has been placed on the diapering area of the person. Addition steps can include sealing a plastic bag for holding the removed used diaper and washing the diapering area.

30 Claims, 17 Drawing Sheets

(56) References Cited

U.S. PATENT DOCUMENTS

| | | | | |
|---|---|---|---|---|
| 10,980,357 | B2 | 4/2021 | Burnside et al. | |
| 11,813,217 | B2 * | 11/2023 | Lim | A61G 7/1055 |
| 11,882,944 | B1 | 1/2024 | Hilliard | |
| 2013/0227792 | A1 | 9/2013 | Schambon | |
| 2017/0020760 | A1 * | 1/2017 | Sang | E03D 9/08 |
| 2020/0109006 | A1 * | 4/2020 | Vu | A61F 13/84 |
| 2020/0390259 | A1 * | 12/2020 | Cooper | A47G 25/905 |
| 2022/0008267 | A1 * | 1/2022 | Nomura | A61G 5/14 |

FOREIGN PATENT DOCUMENTS

| | | | | | |
|---|---|---|---|---|---|
| CN | 111772423 | A | * | 10/2020 | A47D 15/00 |
| JP | 2000334004 | A | * | 12/2000 | |
| JP | 2001029266 | A | * | 2/2001 | |
| JP | 2001029400 | A | * | 2/2001 | A61F 13/84 |
| JP | 2001046444 | A | * | 2/2001 | |
| JP | 2011011028 | A | * | 1/2011 | |

OTHER PUBLICATIONS

Translation JP 2001046444.*
Translation JP 2001029400.*
Translation JP 2001029266.*
Translation JP 2000334004.*
Translation CN 2613195.*
Translation CN 111772423.*
Translation CN 107019607.*

* cited by examiner

AUTOMATIC APPARATUS AND METHOD FOR CHANGING A DIAPER

BACKGROUND

The present disclosure is directed to an improved apparatus and method for automatically changing diapers, and, more particularly, to an improved apparatus and method utilizing a movable core within a frame to perform automatic operations for removing a used diaper on a person located on a backrest on the frame and attaching a new diaper on the person.

Changing diapers is an art that many parents or caregivers may find difficult to acquire or perform conveniently. In the case of replacing a diaper on an infant, when the need arises, the parent or caregiver may, for example, perform the steps of removing and disposing of the used diaper, washing the diapering area of the infant, applying infant skin protectant, such as talcum powder or skin lotion to the infant, and finally putting the new diaper on the infant. Typically, these steps are done manually by hand while holding the infant's feet. While doing these tasks, the parent may further need to restrain the hands of the infant who is extremely curious and attempts to grab on to material in the vicinity. This can be inconvenient or stressful for the parent or caregiver, especially for a parent and a caregiver that is handicapped in some way.

Hence a need exists for a diaper changing apparatus, which also has washing capabilities if the operator so desires, that can reduce or eliminate the inconvenience associated with changing diapers of infants, as well as reducing the water consumed during changing diapers of the infant if the operator also utilizes the washing option. Also, diaper changing is also an issue for some adults, such as older people and/or disabled people who require diapers. Therefore, a need also exists for such an apparatus for adults who require diapers.

SUMMARY

In an implementation, a diaper changing apparatus is provided for automatically removing a used diaper from a person and placing a new diaper on the person. The apparatus includes a frame, including a base portion and a head portion located on the base portion, a backrest located on an upper part of the base portion, wherein the backrest is configured to hold an upper back region of the person, and wherein the backrest is further configured so that a diapering area of the person, that includes a lower back region and upper leg regions of the person, is exposed over an opening in the upper part of the base portion, a core located to be movable inside the frame, and a controller configured to move the core longitudinally from an initial position, spaced apart from the diapering area of the person, into a first position adjacent to the diapering area of the person, to remove the used diaper from the diapering area of the person when the core is in the first position, to dispose of the removed used diaper in a waste tank, to place the new diaper on the diapering area of the person, and to move the core longitudinally away from the diapering area of the person back to the initial position after the new diaper has been placed on the diapering area of the person.

In another implementation, a method is provided for removing a used diaper from a diapering area of a person and placing a new diaper on the person using an apparatus that includes a frame, a backrest to support an upper back region of the person, and a core movable in the frame, the method comprising performing steps of placing the new diaper onto a diapering system located on the core, placing the person on the backrest, moving the core within the frame from an initial position, spaced apart from a diapering area of the person, to a first position adjacent the diapering area, removing the used diaper from the diapering area using a diaper removing system of the core, depositing the removed used diaper into a waste tank after it has been removed from the person by the diaper removing system of the core, moving the diapering system of the core into a position adjacent the diapering area of the person, placing the new diaper, held by the diapering system, onto the diapering area of the person, and moving the core back to the initial position after the new diaper has been placed on the diapering area of the person.

BRIEF DESCRIPTION OF THE DRAWINGS

The drawing figures depict one or more implementations in accord with the present teachings, by way of example only, not by way of limitation. In the figures, like reference numerals refer to the same or similar elements. Furthermore, it should be understood that the drawings are not necessarily to scale.

DETAILED DESCRIPTION

Figure 1:
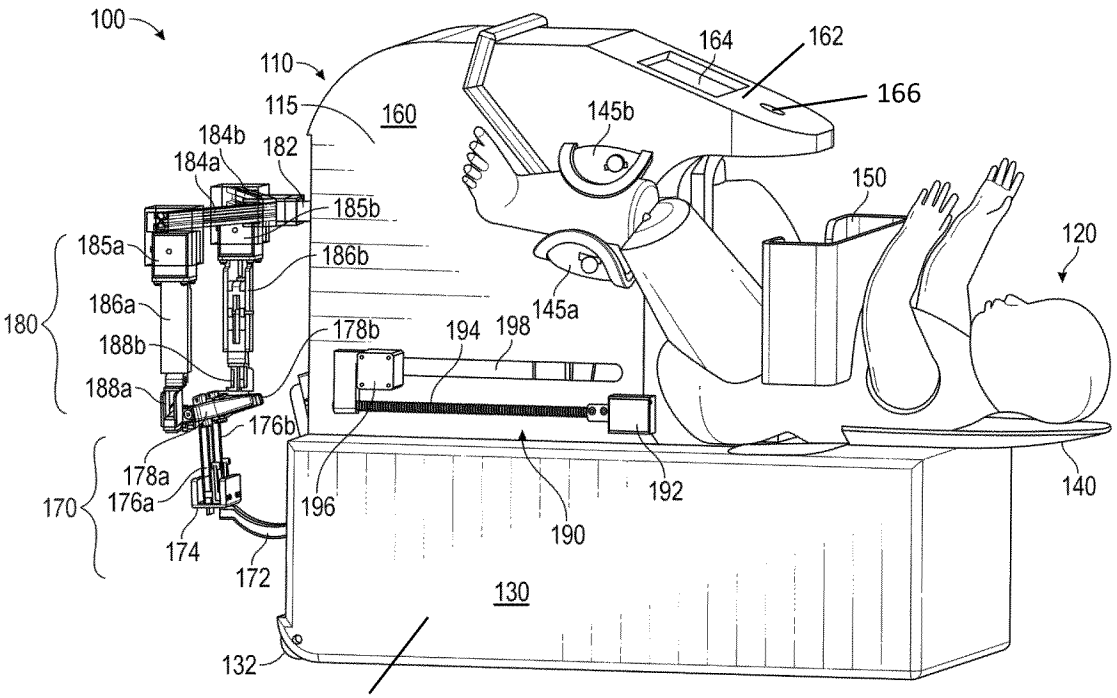
FIG. 1 depicts a perspective view of a diaper changing apparatus, viewed from a side of the apparatus, in an initial position before a diaper changing operation begins in accordance with aspects of this disclosure.

The present disclosure relates to facilitating the process of changing diapers and washing the body for parents and caregivers who take care of children between the ages of three months and three years, the elderly, or the disabled. The device is available in two sizes for children and adults. Also, due to the automatic operation of the apparatus of the present disclosure, it is possible to use it by the person himself, without the help of another person, if preferred. This device can be used in private places such as houses and apartments as well as in public places such as hospitals, kindergartens and nursing homes.

More specifically, this invention is a device for changing diapers and washing a person's body, all of which can be done automatically without manual intervention, which reduces the possibility of transferring contamination or bacteria from the person to the operator and vice versa. It should be noted that the device can be removed from the automatic mode and only the backrest and the leg holders can be used to change the diaper manually, if so desired, or part of the automatic capabilities can be used while other parts of the diaper changing/washing operation can be performed manually while the person rests on the backrest. For example, an operator could use the automatic features of the present disclosure to remove the used diaper and wash the person, and then manually place a new diaper on the person while the person is still laying or sitting with their back on the backrest.

As will be described in more detail below, the working steps of the diaper changing apparatus are: (1) Placing the front and back ears of a new diaper on upper and lower jaws of a diapering system of a movable core that is configured to move longitudinally and rotationally within a frame that the person is located on; (2) Restraining the person's torso and legs with the ability to adjust the height and distance of the restraining elements depending on the size of the person; (3) Detaching the taps of the used diaper by hand while before the diaper changing operation begins; (4) Moving the core longitudinally into a diaper removing position and removing the soiled diaper from the person's body; (5) Transferring the used diaper into a waste tank within the core using diaper removing elements of the core; (6) Sealing a plastic diaper pail refill located in the waste tank with heat to prevent the spread of unpleasant odors; (7) Rotating the core into a position for washing and drying the front and back of the person's body and draining the waste water into a corresponding tank; (8) Rotating the core into a position to transfer and place a new diaper on the person's body using a diapering system of the core that includes upper and lower jaw assemblies; and (9) Moving the core longitudinally away from the person back to the initial position to be ready for the next diaper changing operation. Also, this diaper changing apparatus can be used in with the person being diapered in either a lying position or a sitting position.

Referring to FIG. 1, a perspective view is shown of the diaper changing apparatus 100, viewed from a side of the apparatus, in an initial position before a diaper changing operation begins in accordance with aspects of this disclosure. The diaper changing apparatus 100 includes a frame 110, having a base portion 130 and a head portion 160, frame sidewalls 115 are provided on both the base portion 130 and the head portion 160 for covering internal elements within both the base portion 130 and the head portion 160 of the frame 110. A backrest 140 is located on an upper surface of the base portion 130 and is configured for a person 120 who is being diapered to have at least their upper torso region (and also their head, if desired) supported by the backrest 140 while a lower torso region of the person 120 is located over an opening in the base portion 130 of the frame 110 so that a fixed sink inside the base portion 130 is located beneath the diapering area of the person 120, as will be discussed later in this disclosure.

Leg holders 145*a* and 145*b* are provided on the frame sidewall 115 (on each side of the head portion 160 of the frame 110) to secure the legs of the person 120 during the diapering operations. A belt (not shown) can also be attached to the backrest 140 in a location to be secured around the torso of the person 120 for further securing the person on the frame 110 and the backrest 140. In addition, a protective shield 150 can be provided adjacent a midsection region of the person 120 to protect the person from the jaw assemblies used for changing the diaper, as will be discussed later herein, and to assist in securing the person, as shown in FIG. 1. This protective shield 150 can be used in conjunction with the belt (not shown) that holds the protective shield 150 on the person 120. The protective shield 150 can also prevent water from a washing operation, to be described later, from splashing onto an upper portion of the person 120. Further, the protective shield 150 can also help prevent the person from seeing the diapering apparatus during the diapering operation, which, especially in the case of an infant, could potentially be upsetting.

The protective shield 150 can be a flat plastic plate that has two parts and is placed perpendicular to the person's body. Its outer part is responsible for protecting the person from touching the forks of the jaw assemblies 170 and 180 while changing the diaper, and its inner part is responsible for protecting the contact of the forks with the person's leg. As such, utilizing this two-part shield 150, a suitable and safe space is provided for the movement of forks near the person's body.

Figure 4:
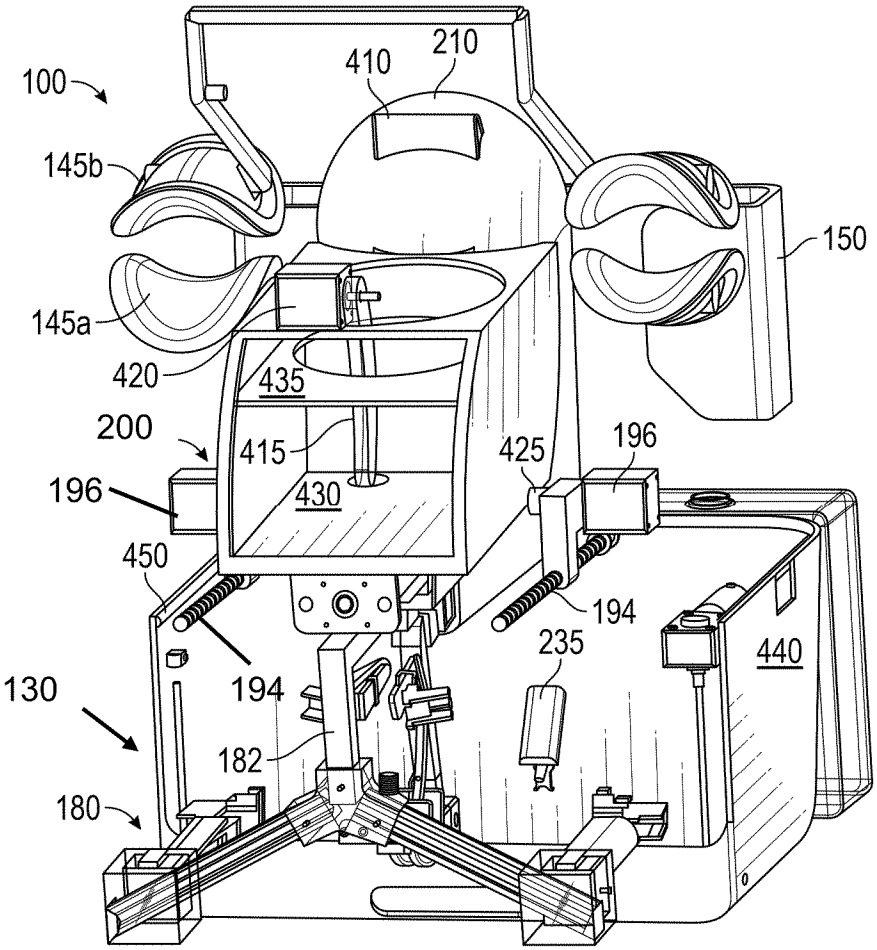
FIG. 4 depicts a cutaway perspective view of internal elements of FIG. 2 viewed from the back of the apparatus when the core is in the washing position in accordance with aspects of this disclosure.

The leg holders include lower leg holders 145*a* and upper leg holders 145*b*. These leg holders 145*a* and 145*b* can either be secured to the legs of the person 120 manually, or they can be secured automatically by a motor (not shown) inside the head portion 160 after the person is placed on the backrest 140 by supporting the persons leg with the lower leg holder 145*a* and closing the upper leg holder 145*b* using the motor to secure the persons leg between the two leg holders. The lower leg holder 145*a* can be fixed in order to support part of the person's weight. The upper leg holder 145*b* is located on the top of the leg and is responsible for keeping the leg stable during the diapering operation. The position of these leg holders 145*a* and 145*b* can be adjustable on the frame sidewall 115 of the head portion 160 of the frame 110. Of course, as shown in FIG. 4, leg holders 145*a* and 145*b* are provided on opposite sides of the diaper changing apparatus 100 to support and secure both of the person's legs.

Figure 6A:
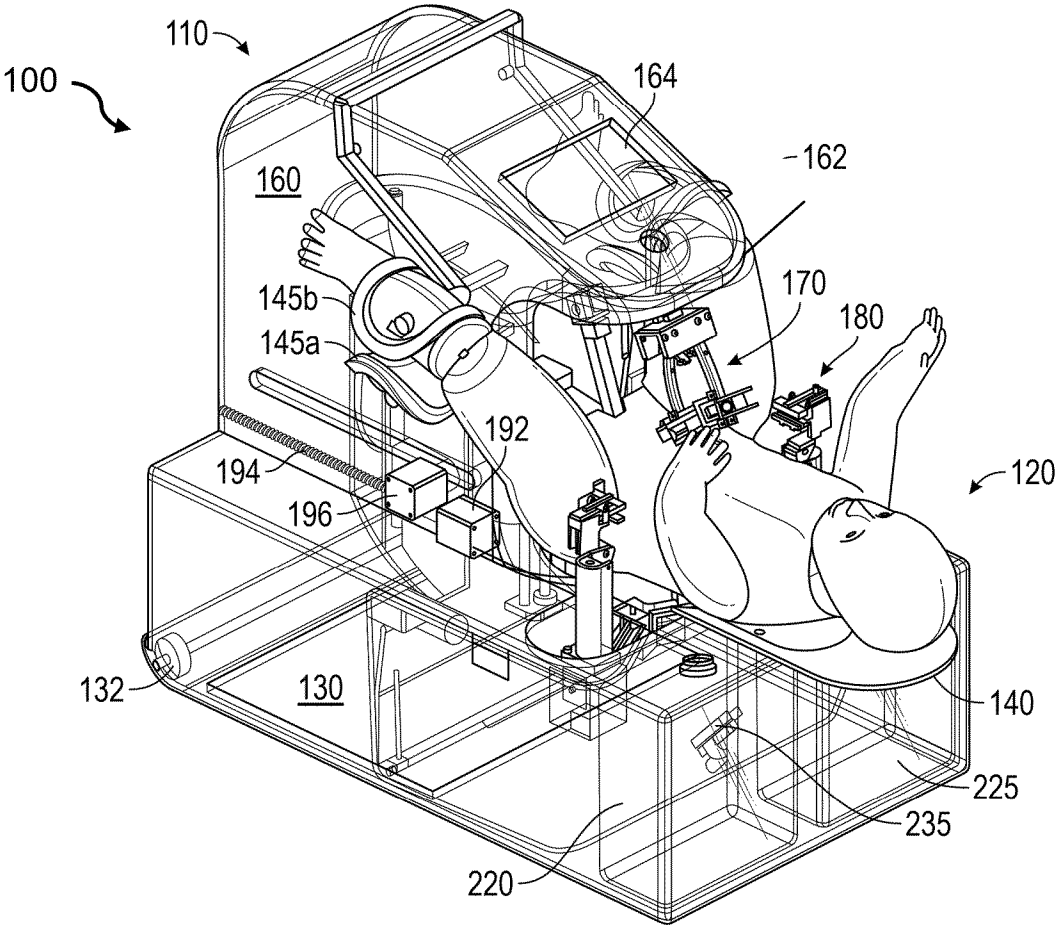
FIG. 6A depicts a perspective cutaway view of the diaper changing apparatus in a diapering position during the diaper changing operation, showing a person mounted on the apparatus, for placing a new diaper on the person in accordance with aspects of this disclosure.
Figure 6B:
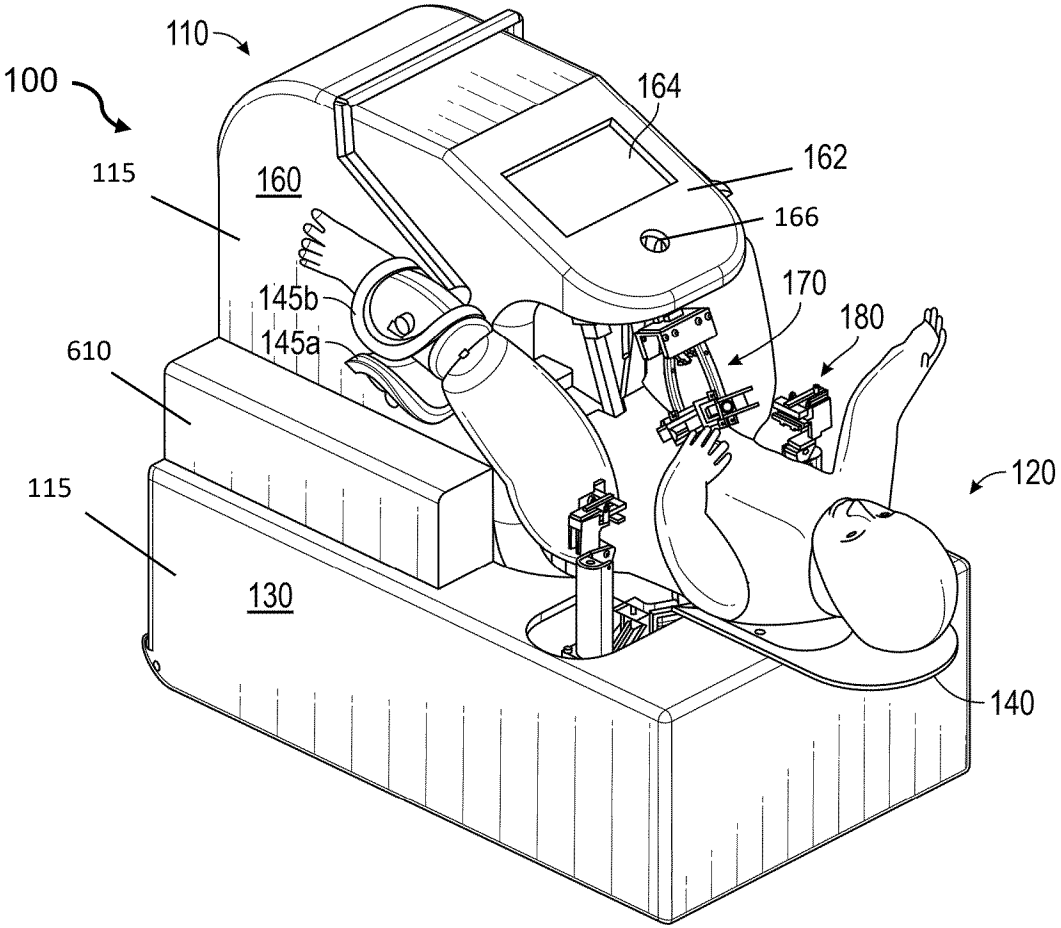
FIG. 6B depicts a perspective view of the diaper changing apparatus in the same diapering position shown in FIG. 6A but with external coverings over the internal elements shown in FIG. 6B in accordance with aspects of this disclosure.

As noted above, the base portion 130 is the lower part of the frame 110 where many of the components of the device, including the backrest 140, are located. The front part of the base portion 130 is cut in such a way that the lower jaw assembly 180 can be easily removed through openings on opposite sides of the person's diapering area (as shown in FIGS. 6A and 6B) in the upper part of the base portion 130 in order to place the diaper on the person's body.

The frame 110 also includes a head portion 160 located on an upper part of the base portion 130. Preferably, the head portion 160 is smaller in width than the base portion 130. Specifically, the base portion 130 is wider than the head portion 160 to allow for the lower jaw assembly 180 (discussed below) to be able to move from outside the frame 110 into and through the base portion 130 into a diapering position on opposite sides of the person 120, as shown for example, in FIGS. 6A and 6B. This will be discussed later in this disclosure.

The backrest 140 is connected to the upper part of the base portion 130 and can be a piece with a special cut that supports the head and torso of the person 120 and is located at an angle close to horizontal, if desired. Depending on the height of the person 120, it is possible to adjust the horizontal distance of the backrest 140 to avoid having the person's torso interfere with the movement of the lower jaw assembly 180. In addition, a seat belt (not shown) can also be connected to the backrest 140. The backrest 140 can have a firm base covered with a soft cloud-like layer and a washable cover. Also, side parts of the backrest 140 can have a higher height than the center of the backrest 140 to limit the possibility of a person rolling of the backrest.

The head portion 160 includes an electronic controller 162 in an upper portion of the head portion 160, including a control panel display screen 164, for controlling the operations to be described herein. The control panel display screen 164 allows an operator, such as a parent, a caregiver or the person 120 themselves (in the case of adults) to provide operational commands to the electronic controller 162 located on or inside the head portion 160. The electronic controller 162 includes a computing device, typically having a PCB board, (not shown) for generating control signals to control the operations of the diaper changing apparatus 100. Specifically, the electronic controller 162 provides control signals to the various motors and pumps to be described herein, using conventional electrical control signal operations.

The control panel display screen 164 can provide a display of the ongoing operations to show stages of operation, internal water temperatures in the water tanks, status of the supply of new diapers, status of the waste tank holding used diapers, and any malfunctions noted by sensors that can be provided on the various motors and pumps described herein. Also, the control panel 164 can be used to display movies, cartoons, photos and play music for one's entertainment. For this purpose, the control panel 164 can be configured to be turned from lying down to parallel to the person's face so that the screen can be easily seen by the person. An On/Off button 166 can also be provided in the electronic controller 162 to control starting the diaper changing operation. The On/Off button 166 can also stop the diaper changing operation along the way, if desired, for example, if a malfunction is noted during the operations or the operator decides to perform some portion of the diaper changing or washing/drying operations manually.

The diaper changing apparatus 100 includes an upper jaw assembly 170 and a lower jaw assembly 180 shown, in this initial position of FIG. 1, as being located outside of the frame 110. As will be explained with reference to FIG. 2, the upper jaw assembly 170 and the lower jaw assembly 180 are part of a core 200 that is movable within the frame 110. The upper jaw assembly 170 includes an upper jaw handle 172, an upper jaw head 174 connected to the upper jaw handle 172, and upper jaw arms 176*a* and 176*b* connected to the upper jaw head 174. The upper jaw assembly 170 also includes an upper jaw fork 178*a* connected to the upper jaw arm 176*a* and an upper jaw fork 178*b* connected to the upper jaw arm 176*b*.

The lower jaw assembly 180 includes a lower jaw handle 182 and lower jaw branches 184*a* and 184*b*. The upper jaw branches 184*a* and 184*b* are respectively connected to lower jaw heads 185*a* and 185*b*, which, in turn, respectively include lower jaw arms 186*a* and 186*b*. Lower jaw forks 188*a* and 188*b* are respectively connected to the lower jaw arms 186*a* and 186*b*. As will be explained in detail later in this disclosure, the upper jaw assembly 170 and the lower jaw assembly 180 are moved through the base portion 130 of the frame 110, including through the walls of the frame 110, when the core 200 is rotated into a position for placing a new diaper on the person 120.

Figure 2:
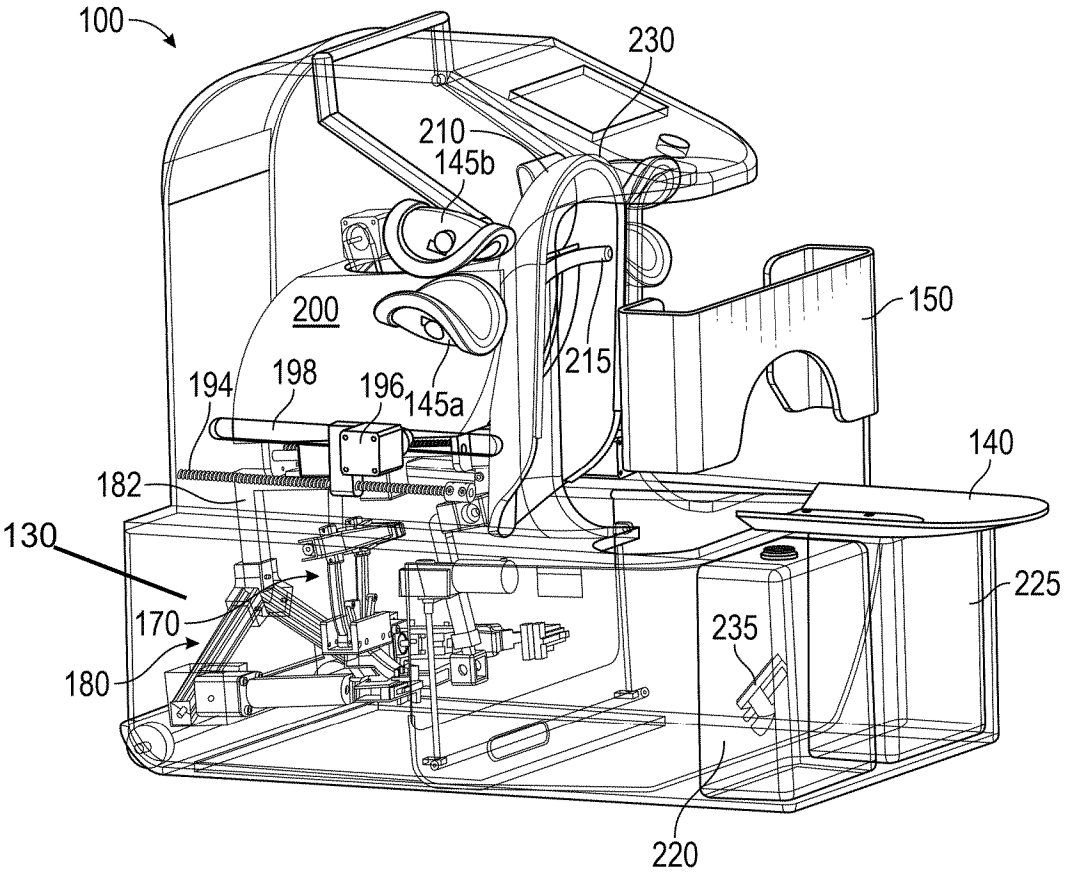
FIG. 2 depicts a perspective cutaway view of the diaper changing apparatus when a movable core within the frame has been moved into a washing position during the diaper changing operation for washing the person being diapered, after a used diaper has been removed and disposed of, in accordance with aspects of this disclosure.
Figure 3:
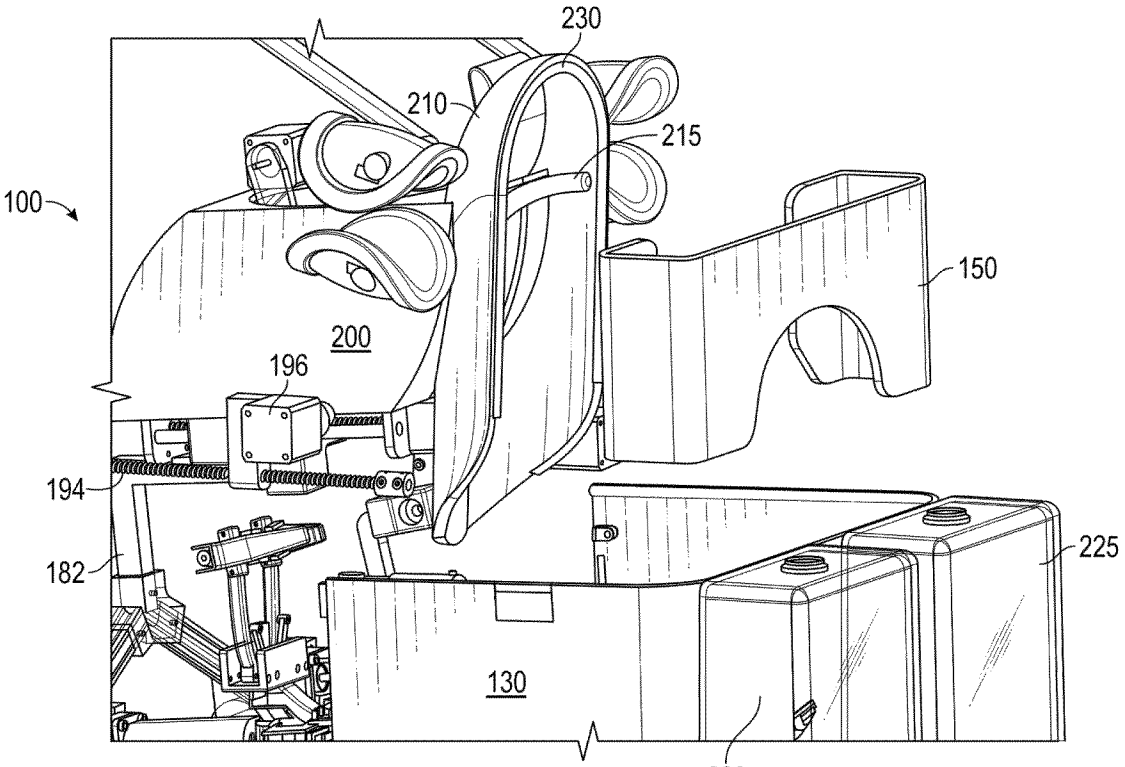
FIG. 3 depicts a close-up cutaway perspective view of elements shown in FIG. 2 in accordance with aspects of this disclosure.

The core 200 shown in FIG. 2 is driven by a core drive system 190 shown in FIGS. 1, 2 and 3. This core drive system 190 includes a core longitudinal drive motor 192 to move the core longitudinally toward and away from the person 120 within the frame 110, a drive screw 194 connected to the longitudinal core drive motor 192, a rotational drive motor 196 connected to the core 200 (as shown in FIG. 2) to rotate the core 200 inside the base portion 130 of the frame 110, and a slot 198 adjacent to the rotational drive motor 196 to allow the rotational drive motor 196 to be connected to the core 200 to rotate the core within the frame 110, as will be described in the following description. Regarding the longitudinal core drive motor 192, this motor can turn the drive screw 194 to move the rotational drive motor 196 longitudinally forward and backward. As can be seen in FIG. 4, the motor 196 is coupled, through the slot 198, to the core 200 via a rotational drive shaft 425 in order to be able to rotate the core 200 into different positions within the frame 110. It is noted that, if desired, a second core drive system 190 can be provided on the opposite side of the head portion 160 with the same drive motors 192 and 196, drive screw 194 and slot 198 to provide greater stability in moving the core 200 through the interior regions of the frame 110.

The frame 110 and core 200 of the apparatus 100 can be made of polymer in order to provide both strength and lightness, as well as for avoiding heat transfer from the internal mechanisms and motors and pumps to the exterior of the frame. Also, the forks 178*a*, 178*b*, 188*a* and 188*b* can have a soft plastic, rubber or fabric cover, if desired, to ensure avoiding any harm to the person receiving the diaper. In addition, by using two or more wheels 132 located in the lower and back part of the frame 110, it permits it to bepair possible to change the position of the person 120 on the backrest 140 from lying down to sitting and vice versa. The wheels 132, of course, also make it easier to carry and move the diaper changing apparatus 100.

FIG. 2 depicts a perspective cutaway view of the diaper changing apparatus 100 when the movable core 200 has been moved forward longitudinally from the initial position shown in FIG. 1 into a first position adjacent the person 120 for removal and disposal of the used diaper, as will be discussed later herein, and prior to rotating the core into a second position for washing and drying the person being diapered, if desired, in accordance with aspects of this disclosure. FIG. 3 depicts a close-up cutaway perspective view of upper elements shown in FIG. 2.

Referring to FIGS. 2 and 3, it is first noted that like-numbered elements in these drawings correspond to the same numbered elements discussed above for FIG. 1. In addition, FIGS. 2 and 3 show elements of the core 200 including a mobile sink 210 having a first nozzle 215 for washing the person 120 following removal of the used diaper (as will be discussed later here in). Optionally, the first nozzle 215 can also be equipped to blow warm air of the diapering area of the person 120 after the washing is completed. In another alternative, a separate dryer (not shown) can be provided in the mobile sink 210 or adjacent thereto for performing the drying operation.

In addition, the interior of the base portion 130 of the frame 110 houses a first water tank 220 and a second water tank 225. As will be discussed below with regard to FIG. 4, the interior of the base portion 130 can serve as a fixed sink to collect waste water from washing the person's body using the first nozzle 215 while lying down. Also, regarding the two water tanks 220 and 225, tank 220 can be used for clean water and tank 225 can be used for sewage, or vice versus. The clean water tank 220 can have a 12 volt heating element (not shown) and a temperature sensor (not shown) that can be used to control the water temperature (for example, to a limit of 98 degrees Fahrenheit) so as not to shock the person during washing with cold water. Both the clean water tank 220 and the waste water tank 225 can have water height detection sensors (not shown) that inform the operator when necessary (for example, through the display screen 164 or via an audible alarm). These water tanks can be connected to nozzles for filling and/or discharging through fully flexible hoses. Alternatively, it is also possible to directly connect the tanks 220 and 225 to local tap water and sewage lines, if desired. There can be water pumps (not shown) in the hoses which are responsible for transporting the clean water and sewage. As also shown in FIGS. 2 and 3, the mobile sink 210 includes second nozzles 230 located along an upper rim of the mobile sink 210 for purposes of cleansing the mobile sink 210 after the person 120 has been washed by the first nozzle 215.

As can be appreciated from FIGS. 2 and 3, the protective shield 150 protects the upper body area of the person 120 from being sprayed while the first nozzle 215 is washing a diapering area of the person. As shown in FIG. 3, a third nozzle 235 can be provided in the interior of the base portion 130 of the frame 110, underneath an opening in an upper region of the base portion 130 which is positioned below the diapering area of the person 120 lying on the backrest 140, for purposes of cleaning off an underside of the person after the used diaper has been removed either before, during or after the first nozzle 215 washes the upper side of the person.

As can also be seen in FIGS. 2 and 3, in comparison with FIG. 1, the longitudinal drive motor 192 (not shown in FIGS. 2 and 3 to allow for a clear view of internal elements) has rotated the screw 194 to advance the rotational motor 196 forward along the screw 194, and adjacent the slot 198, so that the rotational drive shaft 425 (e.g., see FIG. 4) can move the core 200 longitudinally forward towards the person 120 for removing and disposing of the used diaper, as will be discussed below. Then, in this advanced position, the rotational motor 196 can rotate the core 200 so that the mobile sink 210 rotates into a position facing towards the person 120 for washing. At the same time, the rotational movement of the core 200 moves the jaw assemblies 170 and 180 from their initial position outside the frame 110 (shown in FIG. 1) into a position in the interior of the base portion 130 of the frame 110 (as shown in FIGS. 2 and 3).

FIG. 4 depicts a cutaway perspective view of internal elements of the elements of FIG. 2 viewed from the back of the apparatus when the core 200 is in the same washing position shown in FIGS. 2 and 3. As shown in FIG. 4, the core 200 includes additional elements such as a diaper removing fixed lower element 410, a diaper removing upper element 415 and a diaper removing drive motor 420 for driving the diaper removing upper element 415 to assist in removing the diaper.

The interior of the core 200 can serve as a waste tank 430 for storage of the removed used diapers. This waste tank area 430 is covered with a gate 435 which allows dropping or otherwise depositing of a removed used diaper through the gate 435 into the waste tank 430. Further details of the structural arrangement for the waste tank 430 will be discussed below with regard to FIG. 5.

In addition, the base portion 130 of the frame 110 can serve as a fixed sink 440 for catching waste that falls into the base portion 130 during washing of the diapering area of the person 120 using the first and third nozzles 215 and 235 shown in FIGS. 2 and 3. In addition, fourth nozzles 450 can be provided along an upper rim of the fixed sink 440 for by the base portion 130. FIG. 4 also shows that another drive screw assembly 194 with a rotational motor 196 can be provided on the opposite side of the core 200, if desired, to provide more stability for the longitudinal and rotational movements of the core 200.

As discussed above, there can be four nozzles responsible for washing the person's body and the walls of the various sinks. Of course, additional nozzles could be provided if desired for additional cleaning. The first nozzle 215 shown in FIGS. 2 and 3 is located inside the mobile sink 210, and by using the curvature of the mobile sink 210, it sprinkles water on a large part of the front and bottom of the person's body in the diapering area. This first nozzle 215 rotates with the core 200, and, when it is placed at the right angle to the person's body, a water pump (not shown) is turned on by the electronic controller 162 and performs the washing operation. As noted above, the first nozzle 215 can also provide warm air for drying the diapering area after washing.

The second nozzles 230 are located around an upper rim of the mobile sink 210 and are responsible for washing the mobile sink 210. A single nozzle 230 could be used, if desired, with a plurality of openings in the upper rim of the mobile sink 210 used to spray water from the second nozzle uniformly around the sink 210. The third nozzle 235 is a nozzle underneath and/or behind the person's body, as shown in FIG. 2. This third nozzle 235 can be installed in the front of the clean water sink 220 and is responsible for washing the back of the person's body. The position of the third nozzle 235 can be fixed or it can be arranged to be movable to clean different portions of the back of the person and/or the inside of the fixed sink 440. The fourth nozzle 450 can be used to wash the sink 440 after washing the person's body. This fourth nozzle 450 can be a series of small holes around the upper part of the sink 440, or can be a plurality of small nozzles around the rim. The duration and temperature of water spraying from all of these nozzles can be controlled using one or more water pumps which are controlled by the electronic controller 162.

The fixed sink 440 in the interior of the base portion 130 is a relatively large chamber that is located at the bottom of the base portion 130 and which has relatively high walls to prevent sewage from splashing into other parts of the device. The fixed sink 440 can be used to collect water from washing the person's body while the person is lying down. The third nozzle 235 can be connected to the fixed sink 440 and the fourth nozzle 450 is located around the upper edge of the fixed sink 440 to wash the fixed sink. A sewage outlet (not shown) can be provided at an end of the sink 440, which can be connected to the sewage tank 225 or to a local sewage line by a hose.

The mobile sink 210 is attached to the core 200 and can be shaped to look like a toilet seat if desired. As noted above, the first nozzle 215 is preferably disposed inside the mobile sink 210, although it could be located elsewhere on the core 200 if desired, so long as it is positioned to be able to spray the upper portion of the person's diapering area once the used diaper is removed. The movable sink 210 is designed to prevent water from splashing into the interior of the diaper changing device 100 when the person is in the lying position. When the person is in the sitting position, the mobile sink 210 is responsible for the collection of at least some of the waste water from washing the person's body. The first nozzle 215 can also be connected to the movable sink in such a manner to assist the second nozzles 230 located around the upper edge of the movable sink 210 to wash the inside of the movable sink after the person has been washed.

Figure 5:
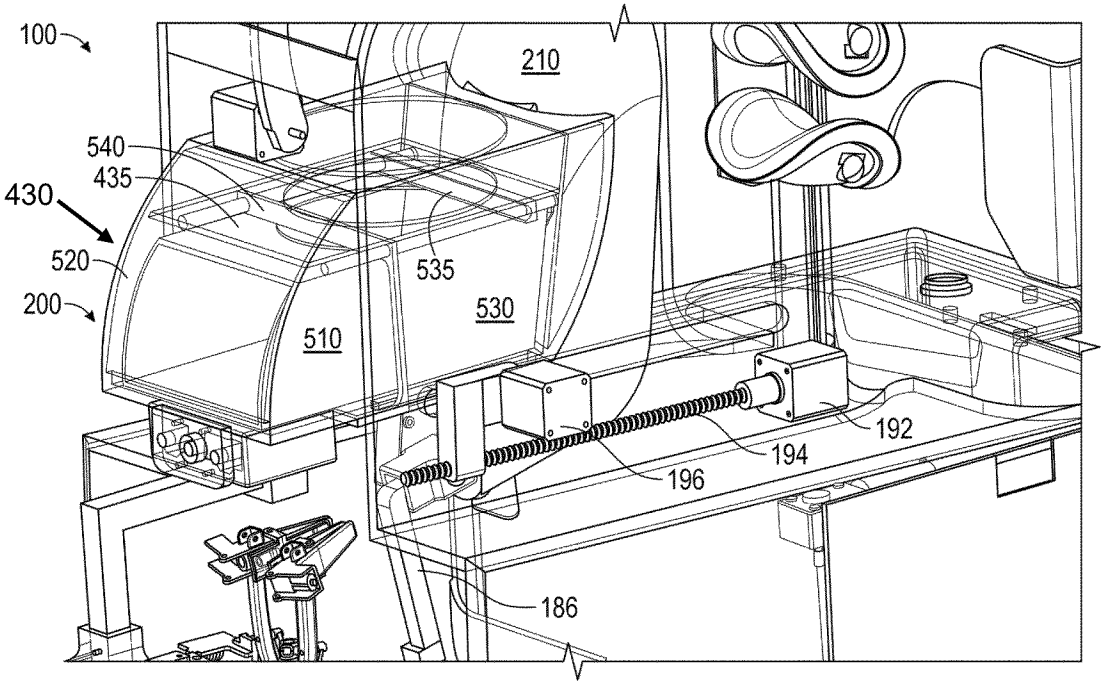
FIG. 5 depicts a close-up cutaway perspective view of elements shown in FIG. 2 particularly showing features of the waste tank within the core in accordance with aspects of this disclosure.

FIG. 5 depicts a close-up cutaway perspective view of elements shown in FIGS. 2-4, particularly showing additional features of the waste tank 430 within the core 200. As shown in FIG. 5, the waste tank 430 can include a diaper refill section 510, a door 520 providing access to the diaper refill section 510 to insert new diapers into the used diaper refill section, and a garbage section 530 for actual storage of the removed used diapers (noting that one or more plastic bags, not shown, can be provided in this garbage section 530 to allow for receiving the removed used diapers). In addition, in order to seal the plastic bag (not shown) in the garbage section 530, a fixed sealing arm 535 and a movable sealing arm 540 can be provided to seal an upper section of the plastic bag. The operations of the elements will be discussed in detail later in this disclosure. The door 520 can also provide access to empty the sealed plastic bag(s) of the garbage section 530, for example, by removing the diaper refill section 510 and the garbage section 530 out of the waste tank 430 through the door 520. Removal of the diaper refill section 510 and the garbage section 530 out of the waste tank 430 through the door 520 also facilitates refilling the diaper refill section 510 and washing out the garbage section 530.

FIG. 6A depicts a perspective cutaway view of the diaper changing apparatus after the core 200 has been rotated from the second washing position into a third diapering position during the diaper changing operation. FIG. 6A shows a person 120 mounted on the apparatus, for placing a new diaper on the person. FIG. 6B depicts a perspective view of the diaper changing apparatus in the same diapering position shown in FIG. 6A but with external coverings over the internal elements shown in FIG. 6B to illustrate how the diaper changing apparatus 100 appears to an operator when the placement of a new diaper is about to take place. Specifically, FIG. 6B shows the frame sidewalls 115 covering the internal elements of both the base portion 130 and the head portion 160. In addition, FIG. 6B shows a core drive cover 610 covering the driving elements such as the drive screw 194 and the drive motors 192 and 196. It is noted that, in this position shown in FIGS. 6A and 6B, a new diaper would actually be held by the jaws of the upper and lower jaw assemblies 170 and 180, but this is not shown in FIGS. 6A and 6B so that the jaw assemblies 170 and 180 can be viewed more clearly. The actual operations of the jaw assemblies 170 and 180 will be discussed later in this disclosure.

Figure 7:
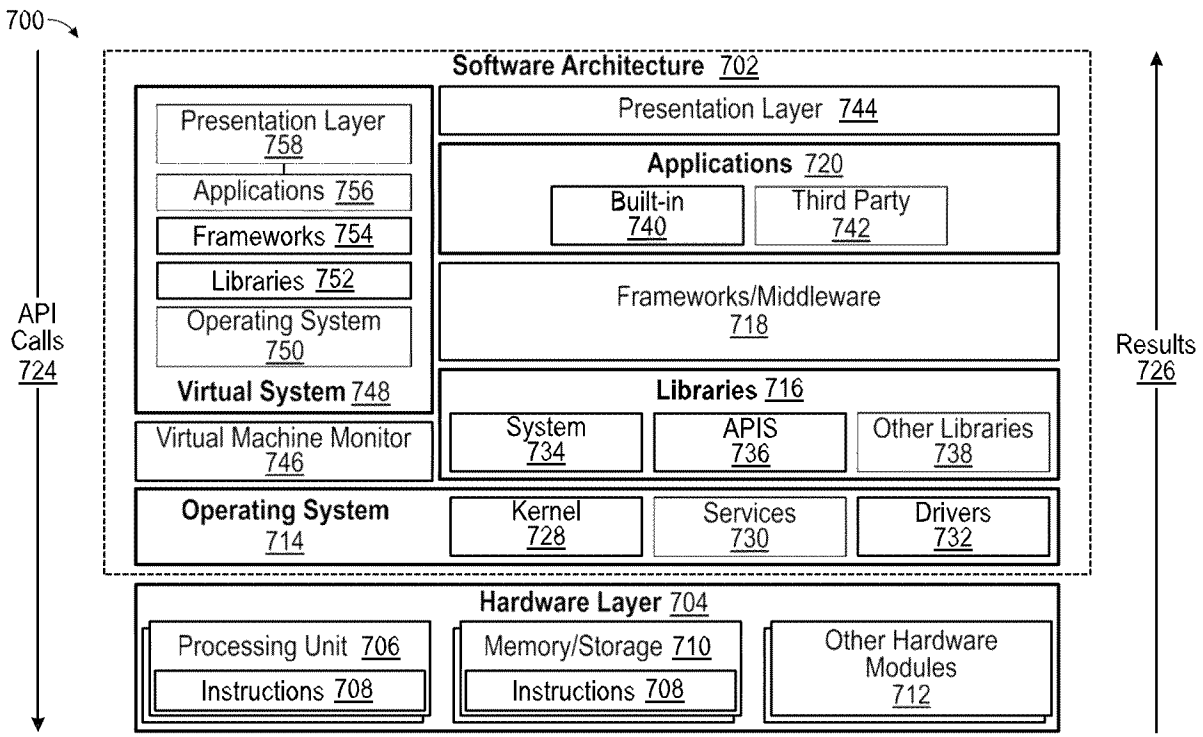
FIG. 7 is a block diagram illustrating an example software architecture, various portions of which may be used in conjunction with various hardware architectures herein described.

FIG. 7 is a block diagram 700 illustrating an example software architecture 702, various portions of which may be used in conjunction with the electronic controller 162, in the form of a computer, herein described, in order to implement any of the above-described and below-described features. FIG. 7 is a non-limiting example of a software architecture and it will be appreciated that many other architectures may be implemented to facilitate the functionality described herein. The software architecture 702 may execute on hardware such as client devices, native application provider, web servers, server clusters, external services, and other servers. A representative hardware layer 704 includes a processing unit 706 and associated executable instructions 708. The executable instructions 708 represent executable instructions of the software architecture 702, including implementation of the methods, modules and so forth described herein.

The hardware layer 704 also includes a memory/storage 710, which also includes the executable instructions 708 and accompanying data. The hardware layer 704 may also include other hardware modules 712. Instructions 708 held by processing unit 706 may be portions of instructions 708 held by the memory/storage 710.

The example software architecture 702 may be conceptualized as layers, each providing various functionality. For example, the software architecture 702 may include layers and components such as an operating system (OS) 714, libraries 716, frameworks 718, applications 720, and a presentation layer 744. Operationally, the applications 720 and/or other components within the layers may invoke API calls 724 to other layers and receive corresponding results 726. The layers illustrated are representative in nature and other software architectures may include additional or different layers. For example, some mobile or special purpose operating systems may not provide the frameworks/middleware 718.

The OS 714 may manage hardware resources and provide common services. The OS 714 may include, for example, a kernel 728, services 730, and drivers 732. The kernel 728 may act as an abstraction layer between the hardware layer 704 and other software layers. For example, the kernel 728 may be responsible for memory management, processor management (for example, scheduling), component management, networking, security settings, and so on. The services 730 may provide other common services for the other software layers. The drivers 732 may be responsible for controlling or interfacing with the underlying hardware layer 704. For instance, the drivers 732 may include display drivers, camera drivers, memory/storage drivers, peripheral device drivers (for example, via Universal Serial Bus (USB)), network and/or wireless communication drivers, audio drivers, and so forth depending on the hardware and/or software configuration.

The libraries 716 may provide a common infrastructure that may be used by the applications 720 and/or other components and/or layers. The libraries 716 typically provide functionality for use by other software modules to perform tasks, rather than rather than interacting directly with the OS 714. The libraries 716 may include system libraries 734 (for example, C standard library) that may provide functions such as memory allocation, string manipulation, file operations. In addition, the libraries 716 may include API libraries 736 such as media libraries (for example, supporting presentation and manipulation of image, sound, and/or video data formats), graphics libraries (for example, an OpenGL library for rendering 2D and 3D graphics on a display), database libraries (for example, SQLite or other relational database functions), and web libraries (for example, WebKit that may provide web browsing functionality). The libraries 716 may also include a wide variety of other libraries 738 to provide many functions for applications 720 and other software modules.

The frameworks 718 (also sometimes referred to as middleware) provide a higher-level common infrastructure that may be used by the applications 720 and/or other software modules. For example, the frameworks 718 may provide various graphic user interface (GUI) functions, high-level resource management, or high-level location services. The frameworks 718 may provide a broad spectrum of other APIs for applications 720 and/or other software modules.

The applications 720 include built-in applications 740 and/or third-party applications 742. Examples of built-in applications 740 may include, but are not limited to, a contacts application, a browser application, a location application, a media application, a messaging application, and/or a game application. Third-party applications 742 may include any applications developed by an entity other than the vendor of the particular system. The applications 720 may use functions available via OS 714, libraries 716, frameworks 718, and presentation layer 744 to create user interfaces to interact with users.

Some software architectures use virtual machines, as illustrated by a virtual machine 748. The virtual machine 748 provides an execution environment where applications/modules can execute as if they were executing on a hardware machine (such as the machine depicted in block diagram 800 of FIG. 8, for example). The virtual machine 748 may be hosted by a host OS (for example, OS 714) or hypervisor, and may have a virtual machine monitor 746 which manages operation of the virtual machine 748 and interoperation with the host operating system. A software architecture, which may be different from software architecture 702 outside of the virtual machine, executes within the virtual machine 748 such as an OS 750, libraries 752, frameworks 754, applications 756, and/or a presentation layer 758.

Figure 8:
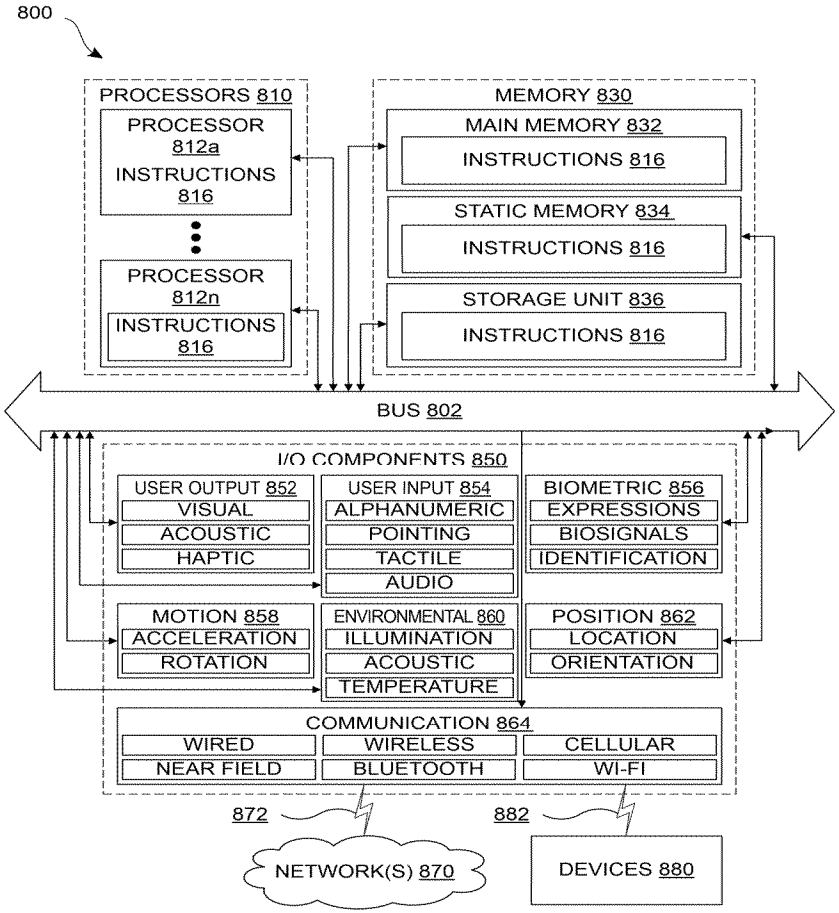
FIG. 8 is a block diagram illustrating components of an example machine configured to read instructions from a machine-readable medium and perform any of the features described herein.

FIG. 8 is a block diagram illustrating components of an example machine 800 configured to read instructions from a machine-readable medium (for example, a machine-readable storage medium) and perform any of the features described herein. The example machine 800 is in a form of a computer system, within which instructions 816 (for example, in the form of software components) for causing the machine 800 to perform any of the features described herein may be executed. As such, the instructions 816 may be used to implement methods or components described herein. The instructions 816 cause unprogrammed and/or unconfigured machine 800 to operate as a particular machine configured to carry out the described features. The machine 800 may be configured to operate as a standalone device or may be coupled (for example, networked) to other machines. In a networked deployment, the machine 800 may operate in the capacity of a server machine or a client machine in a server-client network environment, or as a node in a peer-to-peer or distributed network environment. Machine 800 may be embodied as, for example, a server computer, a client computer, a personal computer (PC), a tablet computer, a laptop computer, a netbook, a set-top box (STB), a gaming and/or entertainment system, a smart phone, a mobile device, a wearable device (for example, a smart watch), and an Internet of Things (IoT) device. Further, although only a single machine 800 is illustrated, the term "machine" includes a collection of machines that individually or jointly execute the instructions 816.

The machine 800 may include processors 810, memory 830, and I/O components 850, which may be communicatively coupled via, for example, a bus 802. The bus 802 may include multiple buses coupling various elements of machine 800 via various bus technologies and protocols. In an example, the processors 810 (including, for example, a central processing unit (CPU), a graphics processing unit (GPU), a digital signal processor (DSP), an ASIC, or a suitable combination thereof) may include one or more processors 812*a* to 812*n* that may execute the instructions 816 and process data. In some examples, one or more processors 810 may execute instructions provided or identified by one or more other processors 810. The term "processor" includes a multi-core processor including cores that may execute instructions contemporaneously. Although FIG. 8 shows multiple processors, the machine 800 may include a single processor with a single core, a single processor with multiple cores (for example, a multi-core processor), multiple processors each with a single core, multiple processors each with multiple cores, or any combination thereof. In some examples, the machine 800 may include multiple processors distributed among multiple machines.

The memory/storage 830 may include a main memory 832, a static memory 834, or other memory, and a storage unit 836, both accessible to the processors 810 such as via the bus 802. The storage unit 836 and memory 832, 834 store instructions 816 embodying any one or more of the functions described herein. The memory/storage 830 may also store temporary, intermediate, and/or long-term data for processors 810. The instructions 816 may also reside, completely or partially, within the memory 832, 834, within the storage unit 836, within at least one of the processors 810 (for example, within a command buffer or cache memory), within memory at least one of I/O components 850, or any suitable combination thereof, during execution thereof. Accordingly, the memory 832, 834, the storage unit 836, memory in processors 810, and memory in I/O components 850 are examples of machine-readable media.

As used herein, "machine-readable medium" refers to a device able to temporarily or permanently store instructions and data that cause machine 800 to operate in a specific fashion. The term "machine-readable medium," as used herein, does not encompass transitory electrical or electromagnetic signals per se (such as on a carrier wave propagating through a medium); the term "machine-readable medium" may therefore be considered tangible and non-transitory. Non-limiting examples of a non-transitory, tangible machine-readable medium may include, but are not limited to, nonvolatile memory (such as flash memory or read-only memory (ROM)), volatile memory (such as a static random-access memory (RAM) or a dynamic RAM), buffer memory, cache memory, optical storage media, magnetic storage media and devices, network-accessible or cloud storage, other types of storage, and/or any suitable combination thereof. The term "machine-readable medium" applies to a single medium, or combination of multiple media, used to store instructions (for example, instructions 816) for execution by a machine 800 such that the instructions, when executed by one or more processors 810 of the machine 800, cause the machine 800 to perform and one or more of the features described herein. Accordingly, a "machine-readable medium" may refer to a single storage device, as well as "cloud-based" storage systems or storage networks that include multiple storage apparatus or devices.

The I/O components 850 may include a wide variety of hardware components adapted to receive input, provide output, produce output, transmit information, exchange information, capture measurements, and so on. The specific I/O components 850 included in a particular machine will depend on the type and/or function of the machine. For example, mobile devices such as mobile phones may include a touch input device, whereas a headless server or IoT device may not include such a touch input device. The particular examples of I/O components illustrated in FIG. 8 are in no way limiting, and other types of components may be included in machine 800. The grouping of I/O components 850 are merely for simplifying this discussion, and the grouping is in no way limiting. In various examples, the I/O components 850 may include user output components 852 and user input components 854. User output components 852 may include, for example, display components for displaying information (for example, a liquid crystal display (LCD) or a projector), acoustic components (for example, speakers), haptic components (for example, a vibratory motor or force-feedback device), and/or other signal generators. User input components 854 may include, for example, alphanumeric input components (for example, a keyboard or a touch screen), pointing components (for example, a mouse device, a touchpad, or another pointing instrument), and/or tactile input components (for example, a physical button or a touch screen that provides location and/or force of touches or touch gestures) configured for receiving various user inputs, such as user commands and/or selections.

In some examples, the I/O components 850 may include biometric components 856, motion components 858, environmental components 860 and/or position components 862, among a wide array of other environmental sensor components. The biometric components 856 may include, for example, components to detect body expressions (for example, facial expressions, vocal expressions, hand or body gestures, or eye tracking), measure biosignals (for example, heart rate or brain waves), and identify a person (for example, via voice-, retina-, and/or facial-based identification). The position components 862 may include, for example, location sensors (for example, a Global Position System (GPS) receiver), altitude sensors (for example, an air pressure sensor from which altitude may be derived), and/or orientation sensors (for example, magnetometers). The motion components 858 may include, for example, motion sensors such as acceleration and rotation sensors. The environmental components 860 may include, for example, illumination sensors, acoustic sensors and/or temperature sensors.

The I/O components 850 may include communication components 864, implementing a wide variety of technologies operable to couple the machine 800 to network(s) 870 and/or device(s) 880 via respective communicative couplings 872 and 882. The communication components 864 may include one or more network interface components or other suitable devices to interface with the network(s) 870. The communication components 864 may include, for example, components adapted to provide wired communication, wireless communication, cellular communication, Near Field Communication (NFC), Bluetooth communication, Wi-Fi, and/or communication via other modalities. The device(s) 880 may include other machines or various peripheral devices (for example, coupled via USB).

In some examples, the communication components 864 may detect identifiers or include components adapted to detect identifiers. For example, the communication components 864 may include Radio Frequency Identification (RFID) tag readers, NFC detectors, optical sensors (for example, one- or multi-dimensional bar codes, or other optical codes), and/or acoustic detectors (for example, microphones to identify tagged audio signals). In some examples, location information may be determined based on information from the communication components 864, such as, but not limited to, geo-location via Internet Protocol (IP) address, location via Wi-Fi, cellular, NFC, Bluetooth, or other wireless station identification and/or signal triangulation.

Figure 9:
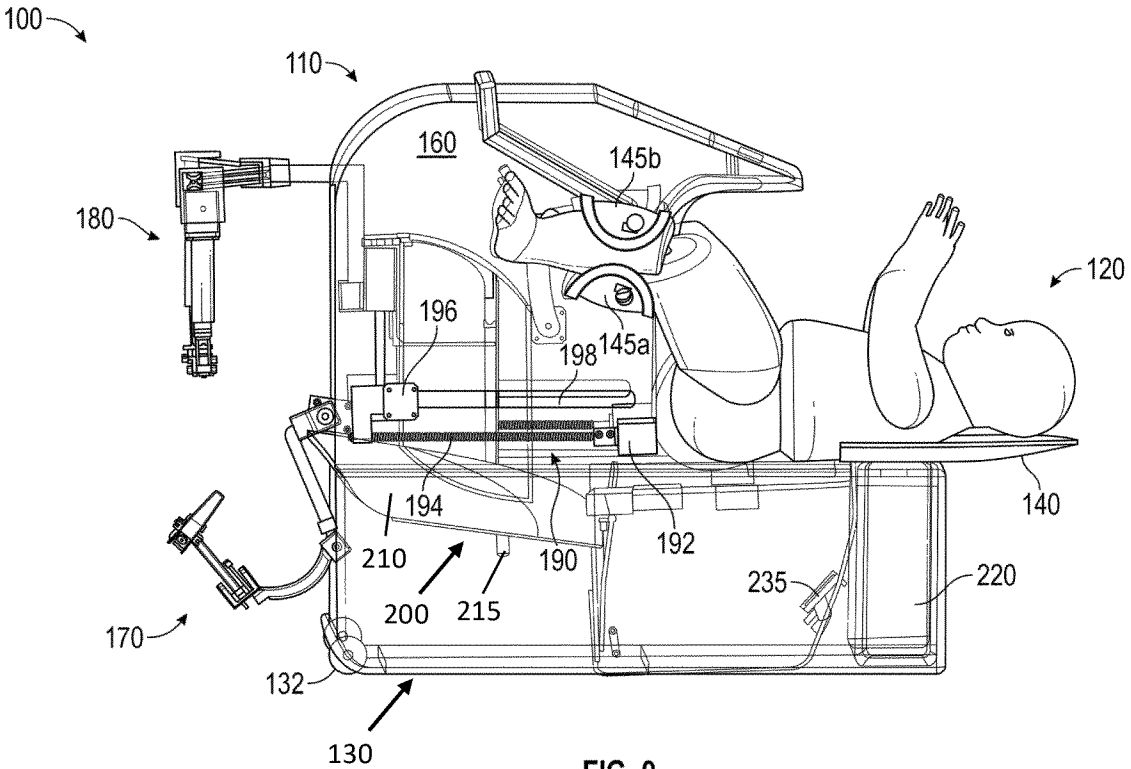
FIG. 9 depicts a side cutaway view of the diaper changing apparatus in the initial position before a diaper changing operation begins in accordance with aspects of this disclosure.

Next, a diaper removing, washing and diapering operation utilizing the diaper changing apparatus 100 set forth above in FIGS. 1-6 will be discussed with reference to FIGS. 9-16. Referring first to FIG. 9 initial working steps of the diaper changing apparatus are as follows: first, the operator delivers a new diaper from the back of the apparatus (e.g., the left side of FIG. 9) to the upper and lower forks of the upper and lower jaw assemblies 170 and 180; second, the person 120 to be diapered is placed on the backrest 140 of the apparatus and their feet are placed on the pair of leg holders 145*a* and 145*b*, and, if desired, can be moved together manually to secure the persons legs; third, a seat belt (if utilized) is fastened around a torso of the person 120 on the backrest 140; fourth, the pair of diaper tapes of a used diaper on the person 120 are opened by the operator or the person themselves prior to the used diaper being removed; and, fifth, the protective shield 150 is placed on the person's body (not shown in FIG. 9, but shown in FIG. 1).

It is noted that FIG. 9 shows the core 200 in the same initial position as is shown in FIG. 1 (except that FIG. 9 is a cutaway view allowing a view of the location of the core 200 in this initial position). As can be seen from FIG. 9, in this initial position the core 200 is located in the interior of the base portion 130 in a manner in which the mobile sink 210 and the first nozzle 215 face downward and the jaw assemblies 170 and 180 are located outside of the frame 110. Also, in order to place the core 200 in this initial position, the longitudinal core drive motor 192 rotates the drive screw 194 to drive the rotational core drive motor 196 to a position away from the person 120 (e.g., the far left of FIG. 9). In this initial position shown in FIGS. 1 and 9, the person is in a position ready for the diaper removing and diapering operations to begin, but no actual steps for diaper changing have taken place yet.

Figure 10:
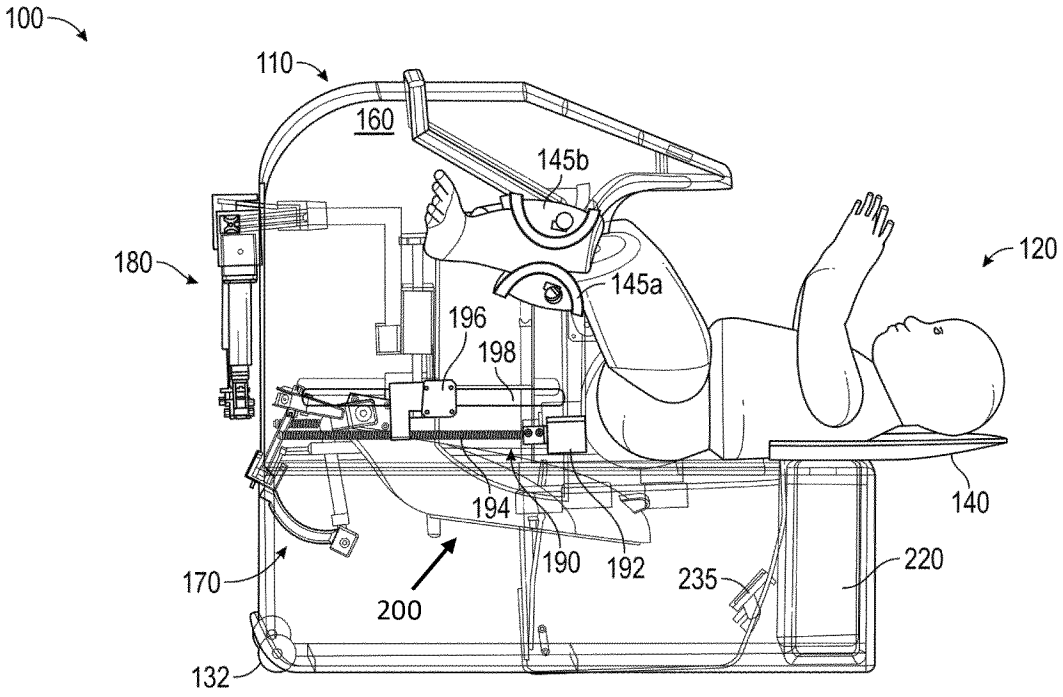
FIG. 10 depicts a side cutaway view of the diaper changing apparatus when the core has been moved longitudinally from the initial position to a first position in which a diaper removing system of the core removes the used diaper in accordance with aspects of this disclosure.

Next, when the operator presses the On/Off button 166, the upper leg holder 145*b* can be moved by a motor coupled to the electronic controller 162 to move toward the lower fixed leg holder 145*a* to accommodate different sizes of the person to secure the position of the legs (although this securing of the legs with the leg holders 145*a* and 145*b* can be done manually, if desired, as noted above). As shown in FIG. 10, the core 200 is then moved towards the person's body. Specifically, this is accomplished by the electronic controller 162 providing a control signal to the longitudinal cove drive motor 192 to rotate the drive screw 194 to move the drive motor 196 (which is connected to the core 200 by the rotational drive shaft 425, as shown in FIG. 4), and thus longitudinally move the core 200 into a first position adjacent to the person 120.

Figure 11:
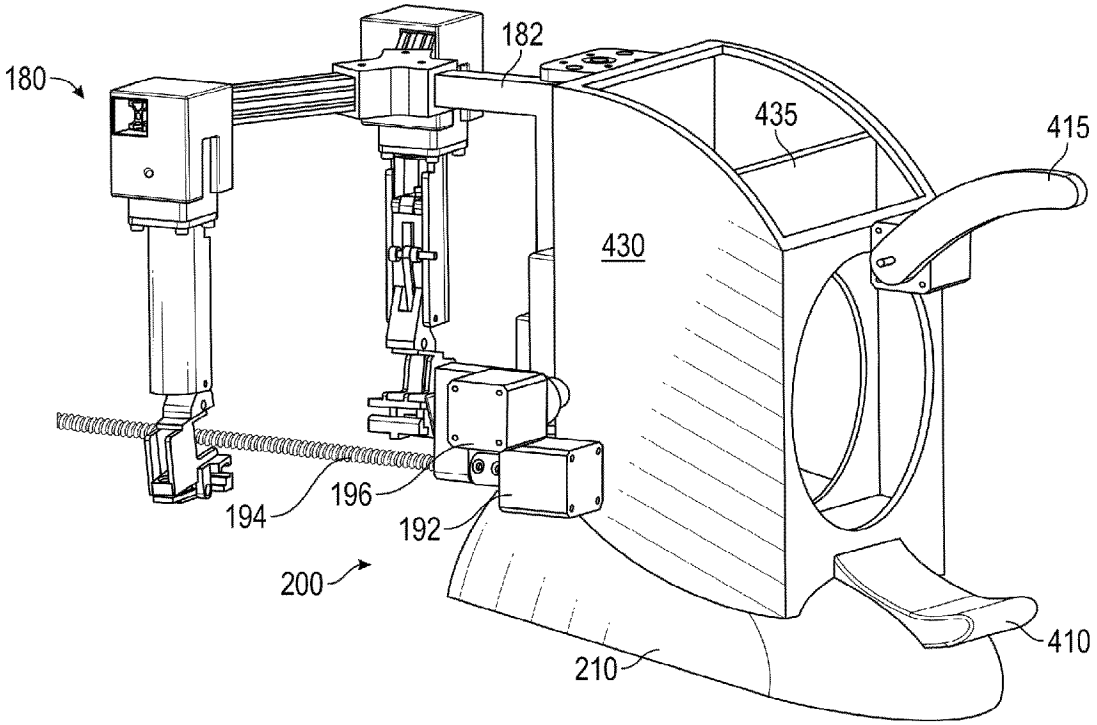
FIG. 11 depicts a perspective view of the diaper removing system of the core in accordance with aspects of this disclosure.

In this first position, the electronic controller 162 then operates the motor 192 to rotate the drive screw 194 further forward, as shown in FIG. 11, to move the core 200 closer to the person so that the fixed diaper removing lower element 410 moves into contact with the lower portion of the used diaper on the person 120 and the movable diaper removing upper element 415 moves into contact with the upper portion of the used diaper (using control signals from the electronic controller 162 to move the upper element 415 with the motor 420). Under the control of the electronic controller 162, the motor 192 then moves the lower element 410 and the upper movable element 415, to grab the soiled used diaper and pull it away from the diapering area of the person 120. The motor 420 can then move the upper movable element 415 downwards to pass the used diaper through the gate 435 into the plastic waste tank 430.

Next, as shown in FIG. 5, the sealing system in the waste tank 430 uses its movable arm 540 to compress a lid of a waste plastic bag in the garbage section 530 and to seal the waste plastic bag with the help of a thermal element (not shown) that is located on or in the movable arm 540. Finally, by moving the upper movable element 415 again into the waste tank 430, via the motor 420, enough space can be provided for the next soiled used diaper to be placed into the waste tank 430.

It is noted that the fixed lower element 410 of the diaper removing system of the core 200 is responsible for separating the rear part of the diaper from the person's body, and it is actually a curved fixed arm in which the tip of the arm is preferably roughened (e.g., like sandpaper) to stick to the diaper. The movable upper part 415 is preferably a movable curved arm that rotates under a limited angle using the corresponding motor 420 and can also have a roughened surface for sticking to the front part of the diaper. This assists in pulling the used diaper towards the waste tank 430 and leaving it inside the waste tank 430.

Figure 12:
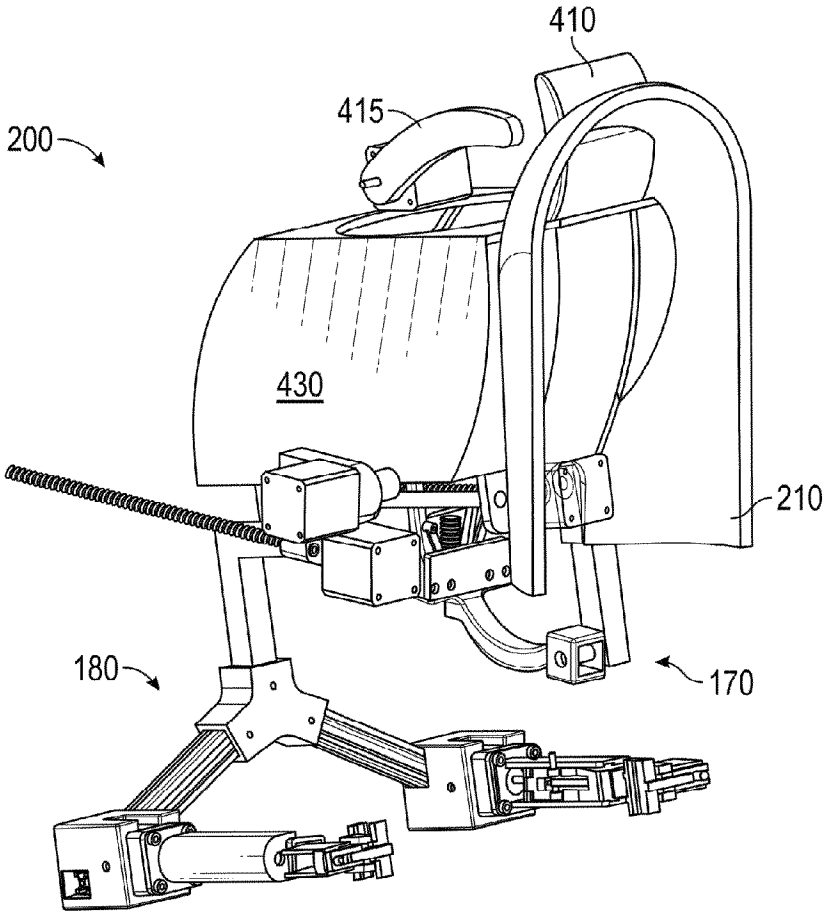
FIG. 12 depicts a perspective view of the core rotated into a second position to wash the diapering area of the person in accordance with aspects of this disclosure.
Figure 13:
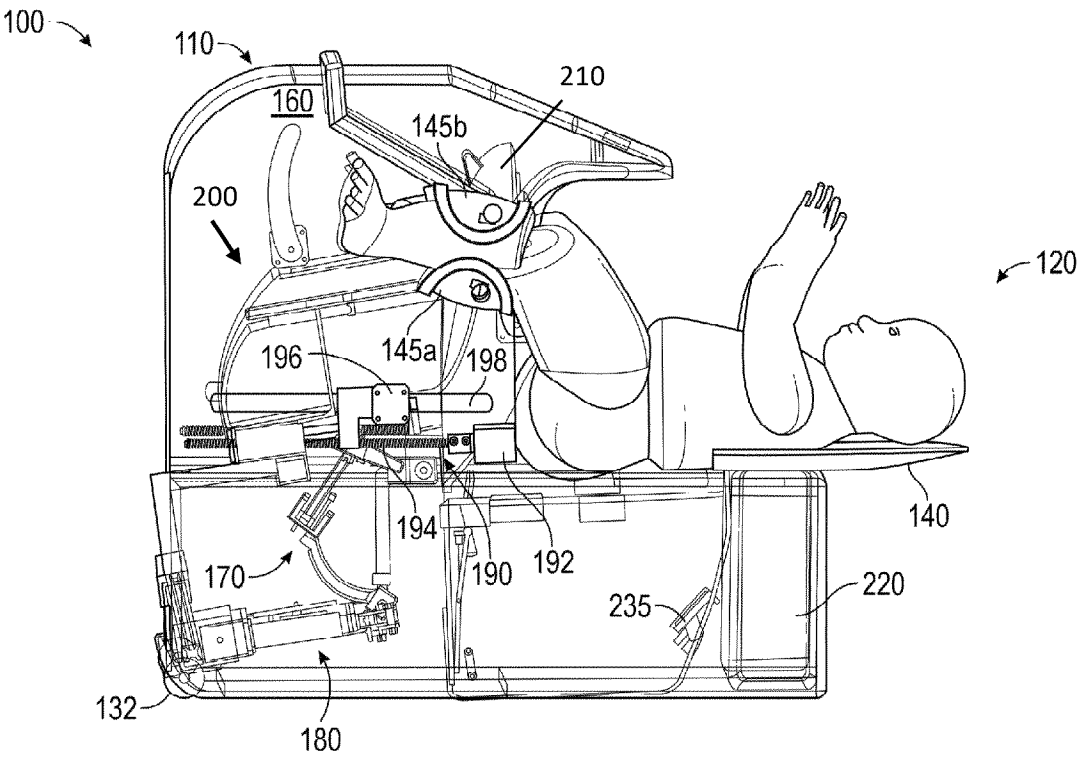
FIG. 13 depicts a cutaway side view of the diaper changing apparatus when the core has been rotated into the second position to wash the diapering area of the person after the used diaper has been deposited in the waste tank within the core in accordance with aspects of this disclosure.

FIGS. 12 and 13 show the core 200 moved into a second position for washing the person 120 after the used diaper has been removed and deposited in the waste tank 430. This second position is achieved by a 90-degree rotation of the core 200 in the anti-clockwise direction from the first position shown in FIG. 10 by the rotational core drive motor 196 so that the mobile sink 210 is placed at substantially a right angle to the person's body with the first nozzle 215 facing toward the diapering area of the person 120 (as illustrated in FIGS. 2 and 3, which also show the core 200 rotated into this second washing position). Preferably, the body washing operation starts with first nozzle 215 operating to wash the upper portion of the diapering area of the person at the same time as operating the sprinkler third nozzle 235 to wash the lower portion of the person. Preferably, warm water for washing the person's body is supplied through the water tank 220 and the connecting hose and the water pump located in the hose path.

Meanwhile, the water hose for nozzles 215 and 235 can pass through one of the horizontal appendages of the core 200, if desired. The heat of the water is provided and maintained in the appropriate range for the human body by a heater and thermostat (not shown) in the water tank 220, which can be adjusted through the user panel on the screen 164. Next, nozzles 230 and 450 wash and rinse the mobile and fixed sinks, and a hot air outlet (not shown), which can be located in or next to the first nozzle 215, can perform a drying operation of the person's body. Then the contents of both the fixed sink 440 and mobile sink 210 are transferred to the sewage tank 225 through a common outlet and a hose and sewage pump (not shown). The clean water tank 220 and sewage tank 225 can be filled and emptied either manually or can be directly connected to the water and sewage hookup.

Figure 14:
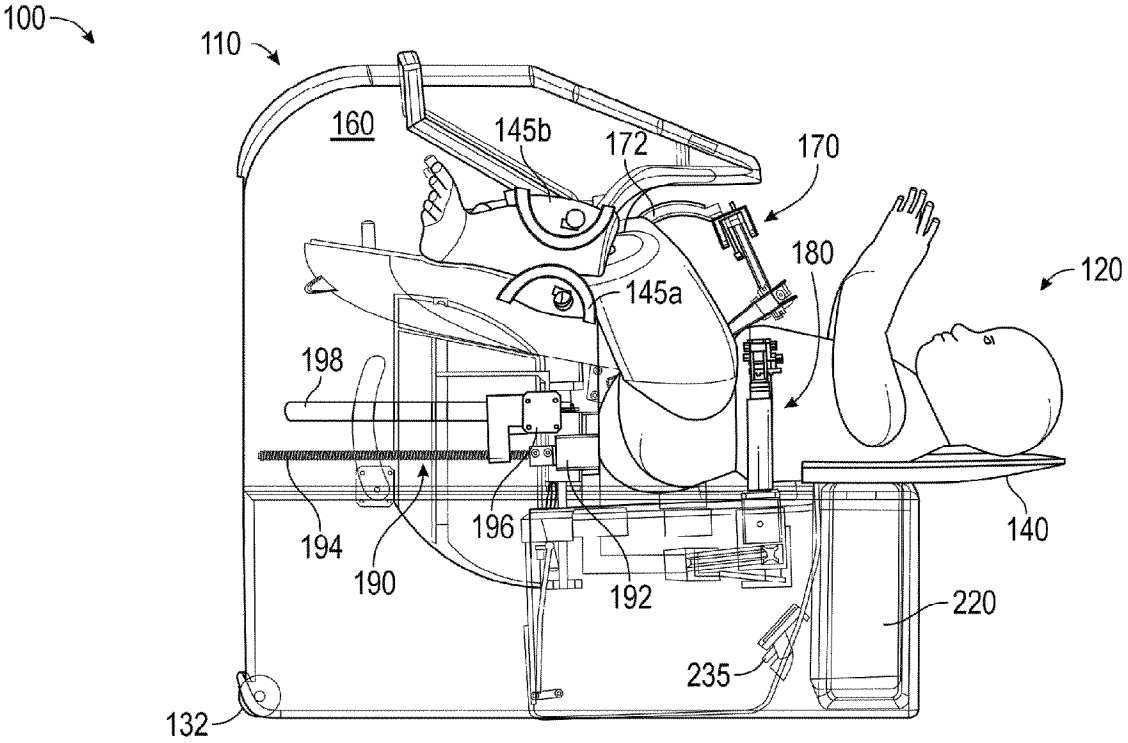
FIG. 14 depicts a cutaway side view of the diaper changing apparatus when the core has been rotated into a third position to place a new diaper on the diapering area of the person in accordance with aspects of this disclosure.

In the next step, shown in FIG. 14 (as well as FIGS. 6A and 6B) by rotating the core 200 another 90 degrees in the counterclockwise direction, the upper and lower jaw assemblies 170 and 180, which have already taken the new diaper in their forks and kept it in a fully open position, are positioned at the right angle to the person's body and then moved horizontally forward (toward the person's body) again by the respective operations of the rotational core drive motor 196 and the longitudinal core drive motor 192. In this position, the upper jaw assembly 170 is placed above the diapering area of the person and the lower jaw assembly 180 is placed with the jaw arms 186*a* and 186*b* on opposite sides of the waist area of the person 120. Then, the upper jaw assembly 170 moves in a clockwise direction while its arms 176*a* and 176*b* are at a suitable distance from each other, placing the front part of the new diaper on the stomach area of the person 120. Then the lower jaw forks 188*a* and 188*b*, using a linear upward movement, pulls back cars the new diaper on the person's waist and finally closes the diaper tapes in a landing zone on the front portion of the new diaper. Once the new diaper has been attached, the upper and lower forks open simultaneously to release the new diaper. Then, based on control signals from the electronic controller 162, the upper and lower jaw arms are moved in the opposite direction and the lower jaw assembly moves vertically downwards, causing forks of the lower jaw assembly to move away from the person's body. Then the upper jaw assembly 170 rotates counterclockwise, under control by the electronic controller 162, to release the diaper tied on the person's body and move away from the person.

Finally, after the new diaper is attached to the person 120, the core 200 is moved horizontally by the longitudinal core drive motor 192 backwards (away from the person's body) and then rotated 180 degrees clockwise to return to its initial position shown in FIGS. 1 and 9 to prepare for the next diaper change operation.

All of the above-described operations are the same for both the lying and sitting positions, with the difference being that, in the lying position, the diaper is delivered to the forks from the back (left side) of the apparatus, while, in the sitting position, the diaper is delivered to the forks from the lower part of the apparatus.

Figure 15B:
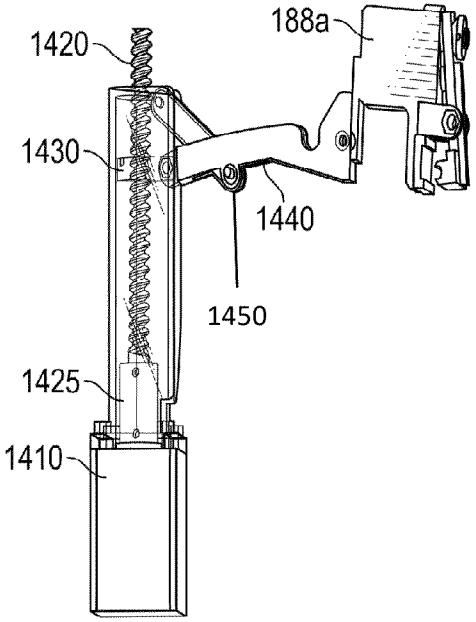
FIGS. 15A and 15B are side views of a portion of a lower jaw assembly of the diapering system of the core in different positions to implement a landing mechanism operation for securing the tabs (e.g., the back cars) on the back part of the new diaper to the front part of a diaper to the person in accordance with aspects of this disclosure.
Figure 15A:
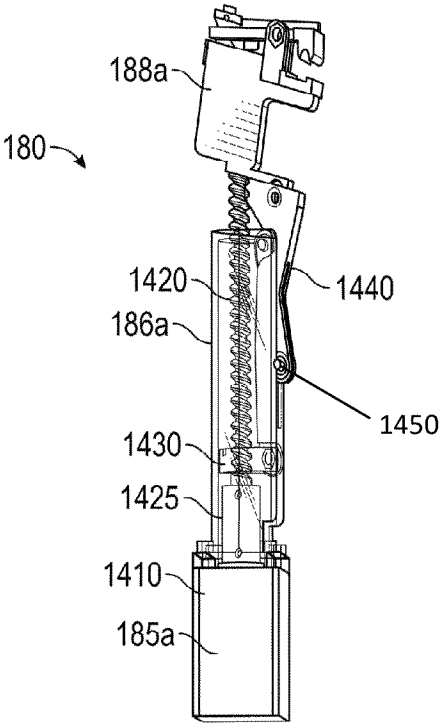

FIGS. 15A and 15B show operations of one of the lower jaw arms 186*a* and its corresponding lower jaw fork 188*a* of the lower jaw assembly 180 once the core 200 has been moved into the diapering position shown in FIG. 14. It is noted that a corresponding operation would take place for the other lower jaw arm 186*b* and its corresponding lower jaw fork 188*b* on an opposite side of the person 120. In particular, FIGS. 15A and 15B show the operation of the lower jaw arms 186*a* and 186*b* to perform as a landing mechanism to perform a landing operation to actually place the tape on back portion of the new diaper over the front portion of the new diaper being held by the upper draw assembly 170 during the diapering operation. It is noted that in both FIG. 15A and FIG. 15B, the back portion of the new diaper would be gripped by the lower jaw fork 188*a*. As discussed above with regard to the diapering operation, FIG. 15A corresponds to the position of the lower jaw arm 186*a* and the lower jaw fork 188*a* shown in FIG. 14 in which the back portion of the new diaper (not shown) is being held along opposite sides of the person 120. FIG. 15B shows the landing mechanism operation for moving the lower jaw fork 188*a* into a position where it will place the gripped back portion of the new diaper onto the front portion of the diaper being held on the abdomen of the person 120 by the upper jaw assembly 170.

In particular, this landing mechanism operation allows the lower jaw fork 188*a* (as well as the lower jaw fork 188*b* on the opposite side of the person) to press the sticky side of a diaper tab at the edge of the back portion of the new diaper onto the exposed surface of the front portion of the new diaper that is being held in place by the upper jaw forks 178*a* and 178*b* of the upper jaw assembly 170. Once the sticky portion of the diaper tab is pressed into contact with the front portion of the new diaper by the lower jaw forks 188*a* and 188*b*, the lower jaw forks 188*a* and 188*b* will release the tapes of the back portion of the diaper and return to the position showing in FIG. 15A. A rigid piece 1450 has an upper end hinged to upper jaw arm 186*a* and a lower end hinged to a lower jaw hinged handle 1140 to provide the necessary force to move the jaws away. These operations are performed based on control signals provided by the electronic controller 162 to a lower jaw drive motor 1410 shown in FIGS. 15A and 15B as well as to a small internal motor (not shown) either inside of or attached to the lower jaw forks 188*a* and 188*b* to control their gripping and releasing operations.

More particularly, the lower jaw arm 186*a* is connected to a lower jaw head 185*a* shown in FIG. 15A (noting that the following discussion also pertains to the operations of the lower jaw head 185*b*, the lower jaw arm 186*b* and the lower jaw fork 188*b*). The lower jaw motor 1410 is coupled to a lower jaw drive rod 1420 via a coupling 1425 in order to provide rotational movement to the lower jaw drive rod 1420. A lower jaw drive nut 1430 is provided on the lower jaw drive rod 1420 so that, when a control signal is provided to the lower jaw drive motor 1410 by the electronic controller 162, it will rotate the lower jaw drive rod 1420, via the coupling 1425, to move the lower jaw drive nut 1430 upwardly along the lower jaw drive rod 1420. This upward motion of the lower jaw drive nut 1430 will cause the lower jaw hinged handle 1440 to move the lower jaw fork 188*a* from the position shown in FIG. 15A to the landing mechanism position shown in FIG. 15B. Once the attachment of the new diaper has been completed, as described above, the electronic controller 162 will provide a signal to the lower jaw drive motor 1410 to drive the lower jaw drive rod 1420 in an opposite direction to drive the lower jaw drive 1430 downward and return the lower jaw fork 188*a* to its original position showing in FIG. 15A via the motion imparted to the lower jaw hinge handle 1440.

As can be seen from the above discussion, the upper jaw assembly 170 is responsible for carrying the front part of the new diaper. As discussed with reference to FIG. 1, this upper jaw assembly has a two-part upper jaw handle 172, an upper jaw head 174 and two upper jaw arms 176*a* and 176*b*. At the top of each upper jaw arm there is an upper jaw fork (178*a* and 178*b*) to catch and release the front cars of the diaper. In order to assist in the diaper removal operation, an operator (or the person themselves, in the case of an adult placing a diaper on themselves) can detach the tapes, which can be referred to as cars, holding front portions of the diaper together. A motor (not shown) connected to the upper jaw arms 176*a* and 176*b* allows the two arms to move closer together and farther apart, and as a result, moves the forks 178*a* and 178*b* of the upper jaw assembly as necessary to assist in the placement of a new diaper on the person.

The upper jaw assembly 170 is directly connected to the core 200 and a motor (not shown) rotates the upper jaw assembly 170 to the point shown in FIG. 14 where the new diaper will be attached. By using this rotation, the two parts of the upper jaw handle 172 can be folded and opened, which allows the front of the new diaper to reach greater distances from the core 200. In other words, there is a pivot in the middle part of the upper jaw handle 172, which allows shortening and lengthening of the upper jaw assembly 170. Another point is that the two arms 176*a* and 176*b* in the upper jaw assembly 170 have a curve corresponding to the curve of the human abdomen so that the upper jaw forks 178*a* and 178*b* optimally position the front of the new diaper on the person's body.

The forks 178*a* and 178*b* of the upper jaw assembly 170 are responsible for catching and releasing the back ears of the diaper. The upper jaw forks 178*a* and 178*b* have a mini motor, a screw, a nut, two jaws, a spring (not shown, although the arrangement is substantially the same as described above regarding the operation of the lower jaw arms 186*a* and 186*b*). In this way, the two jaws 176*a* and 176*b* of these forks are connected from the middle part and have the possibility to move freely. Grooves can be provided in the front part of the upper jaw forks 178*a* and 178*b* to hold the front cars of the diaper firmly. In the upper jaw forks 178*a* and 178*b*, the motor body (not shown) can be mounted perpendicularly to the jaws 176*a* and 176*b* of the forks. Similar to the operations described above regarding FIGS. 15A and 15B, by turning the screw, the motor causes the nut to move, and the nut causes the jaws of the fork to get closer to each other. A spring provides the necessary force to move the jaws away.

As noted above, the lower jaw assembly 180 is responsible for carrying the back part of the new diaper. The lower jaw assembly 180 has a handle part 182 and head parts 185*a* and 185*b* (e.g., see FIG. 1). In the handle part 182, there is a vertical bar and a horizontal bar, and the end of the horizontal bar has two branches 184*a* and 184*b* so that there is one branch for the left part of the new diaper and the other branch for the right part of the new diaper. The lower jaw heads 185*a* and 185*b* are respectively located at the end of both branches 184*a* and 184*b*. There is a motor (not shown) in each head, which closes the back ears the new diaper on the person's body using the landing mechanism discussed above. The distance between the head of the two branches 184*a* and 184*b* is set to be slightly larger than the width of the person's waist, so that the lower jaw branches do not touch the person's waist while rising through the openings in the upper part of the base portion 130, as shown in FIG. 14.

The landing mechanism discussed above is the manner in which the lower jaw forks 188*a* and 188*b* of the lower jaw assembly 180 land on the abdomen of the person's body to close the new diaper. This mechanism is done by turning the rod 1420 by the motor 1410 in the lower jaw heads 185*a* and 185*b*, thus moving the nuts 1430, as discussed above with regard to FIGS. 15A and 15B. The middle of the hinged handle 1440 is hinged to a retaining handle to give it a swinging motion, allowing the lower jaw handle 182 and forks 188*a* and 199*b* to be repositioned from a completely vertical position to a near-horizontal position. The degree of approaching the horizontal level depends on the size of the person and the size of the new diaper being used.

As also discussed above with regard to FIGS. 15A and 15B, the forks 188*a* and 188*b* of the lower jaw assembly 180 are responsible for catching and releasing the back cars of the new diaper.

In addition to the operations noted above, the electronic controller 162 is also responsible for controlling the temperature of the water and the dryer that can be located in or next to the first nozzle 215 in the mobile sink 210. The electronic controller 162 also controls the duration of washing and adjusting the position of the components based on the size of the diaper, as well as opening and closing the forks of the upper and lower jaw assemblies 170 and 180 to transfer and attach a new diaper. Essentially, the electronic controller 162 provides the ability to use the device in two modes: 1.) It can provide diaper changing and body washing, as discussed above; and 2.) It can provide for diaper changing without washing. It is also possible to stop the process at any time during the process by operation of the On/Off button 166. In addition, the diaper changing apparatus 100 can be connected to a mobile phone and computer through the Internet and interact with its own application on Windows, iOS, etc.

It is further noted that the control panel display screen 164 can serve as both a control panel and a monitor. For example, this display screen 164 can display the current temperature of the water in the tanks 220 and 225, or in the nozzles, the temperature of a dryer (e.g., in the nozzle 215), and the stage the device is in, in addition to receiving the commands entered into the device by the user (a touch screen display). An addition, the display screen 164 can serve as a monitor to play cartoons, music or video for the entertainment and distraction of the person 120 during the operation.

It is also noted that the electronic controller 162 can be coupled to a closed-circuit camera located on or adjacent to the frame 110 to take pictures and videos of a person's feces in the used diaper and analyze it using AI (artificial intelligence) technology. This can allow for reporting possible problems to the operator through a mobile application and/or online reporting of possible problems or diseases to the operator through the mobile application, such as skin diseases, digestive diseases, etc. The use of such a closed-circuit camera can also ensure the proper functioning of the device in different stages, including washing the person's body.

As another option, it is noted that an ultraviolet lamp (not shown) can be installed on top of the sinks 210 and 440 and can be used to sterilize these sinks after each use.

Figure 16:
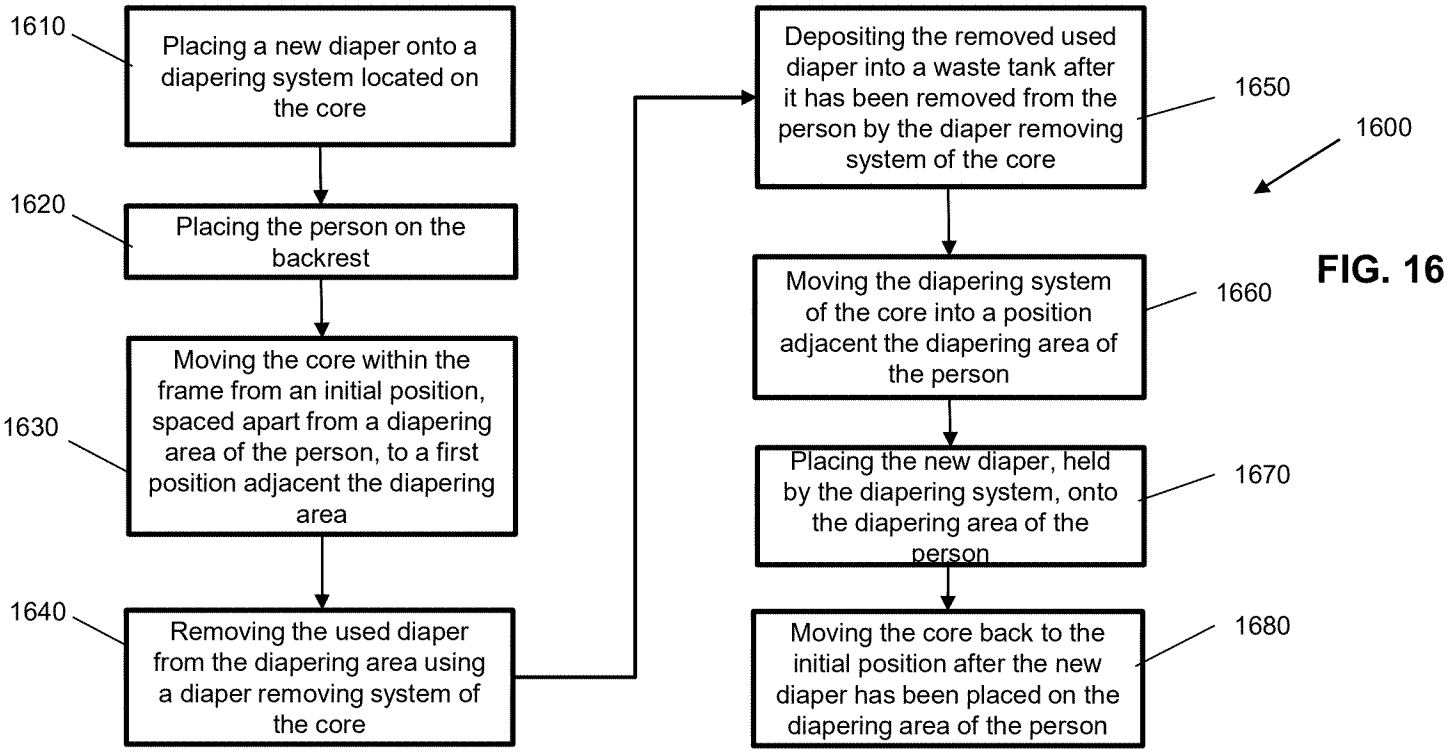
FIG. 16 is a flowchart of steps for the diaper changing operation in accordance with aspects of this disclosure.

Referring next to FIG. 16, a flowchart 1600 shows overall operations of diaper changing apparatus 100. In step 1610, a new diaper is placed onto a diapering system made up of the upper and lower jaw assemblies 170 and 180 located on the core 200 when the core 200 is located in the initial position shown, for example, in FIGS. 1 and 9. In step 1620, the person 120 is placed on the backrest 140, while the core 200 is still in the initial position, as also shown in FIGS. 1 and 9. In step 1630, the core 200 is moved within the frame 110 from the initial position of FIGS. 1 and 9, in which the core 200 spaced apart from a diapering area of the person 120, to a first position adjacent the diapering area, as shown in FIG. 10. In step 1640, the used diaper is removed from the diapering area using a diaper removing system (made up of the fixed element 410 and the movable element 415) of the core 200, as shown in FIG. 11.

Still referring to FIG. 16, in step 1650 the removed used diaper is deposited by the fixed element 410 and the movable upper element 415 into a waste plastic bag in waste tank 435 after it has been removed from the person by the diaper removing system of the core 200. Following the step 1650, waste plastic bag can then be completely sealed by the sealing mechanism described above to prevent the release of unpleasant odors. In step 1660, the diapering system (i.e., the upper and lower jaw assemblies 170 and 180) of the core 200 is moved into a position adjacent the diapering area of the person 120, as shown in FIG. 14. It is noted that, although it is not required for changing the diaper, an intermediate step can be performed of washing the person's diapering area, after the used diaper has been removed in step 1640, as shown in FIGS. 2-4 and 12. Once the core has been rotated into the diapering position of FIG. 14, the jaw assemblies 170 and 180 can place the new diaper, held by the jaws, onto the diapering area of the person 120, as shown in step 1670. Finally, after the new diaper has been placed on the diapering area of the person, and the tape tabs on the back portion of the diaper have been pressed into place by the landing mechanism operation of the lower jaw assembly 180, as described herein, in step 1680 the core 200 is moved back to the initial position shown in FIG. 1 where it is ready to have a new diaper placed on the jaw assemblies 170 and 180.

The detailed examples of systems, devices, and techniques described in connection with FIGS. 1-16 are presented herein for illustration of the disclosure and its benefits. Such examples of use should not be construed to be limitations on the logical process implementations of the disclosure, nor should variations of user interface methods from those described herein be considered outside the scope of the present disclosure. In some implementations, various features described in FIGS. 1-16 are implemented in respective modules, which may also be referred to as, and/or include, logic, components, units, and/or mechanisms. Modules may constitute either software modules (for example, code embodied on a machine-readable medium) or hardware modules.

In some examples, a hardware module may be implemented mechanically, electronically, or with any suitable combination thereof. For example, a hardware module may include dedicated circuitry or logic that is configured to perform certain operations. For example, a hardware module may include a special-purpose processor, such as a field-programmable gate array (FPGA) or an Application Specific Integrated Circuit (ASIC). A hardware module may also include programmable logic or circuitry that is temporarily configured by software to perform certain operations, and may include a portion of machine-readable medium data and/or instructions for such configuration. For example, a hardware module may include software encompassed within a programmable processor configured to execute a set of software instructions. It will be appreciated that the decision to implement a hardware module mechanically, in dedicated and permanently configured circuitry, or in temporarily configured circuitry (for example, configured by software) may be driven by cost, time, support, and engineering considerations.

Accordingly, the phrase "hardware module" should be understood to encompass a tangible entity capable of performing certain operations and may be configured or arranged in a certain physical manner, be that an entity that is physically constructed, permanently configured (for example, hardwired), and/or temporarily configured (for example, programmed) to operate in a certain manner or to perform certain operations described herein. As used herein, "hardware-implemented module" refers to a hardware module. Considering examples in which hardware modules are temporarily configured (for example, programmed), each of the hardware modules need not be configured or instantiated at any one instance in time. For example, where a hardware module includes a programmable processor configured by software to become a special-purpose processor, the programmable processor may be configured as respectively different special-purpose processors (for example, including different hardware modules) at different times. Software may accordingly configure a particular processor or processors, for example, to constitute a particular hardware module at one instance of time and to constitute a different hardware module at a different instance of time. A hardware module implemented using one or more processors may be referred to as being "processor implemented" or "computer implemented."

Hardware modules can provide information to, and receive information from, other hardware modules. Accordingly, the described hardware modules may be regarded as being communicatively coupled. Where multiple hardware modules exist contemporaneously, communications may be achieved through signal transmission (for example, over appropriate circuits and buses) between or among two or more of the hardware modules. In implementations in which multiple hardware modules are configured or instantiated at different times, communications between such hardware modules may be achieved, for example, through the storage and retrieval of information in memory devices to which the multiple hardware modules have access. For example, one hardware module may perform an operation and store the output in a memory device, and another hardware module may then access the memory device to retrieve and process the stored output.

In some examples, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by, and/or among, multiple computers (as examples of machines including processors), with these operations being accessible via a network (for example, the Internet) and/or via one or more software interfaces (for example, an application program interface (API)). The performance of certain of the operations may be distributed among the processors, not only residing within a single machine, but deployed across a number of machines. Processors or processor-implemented modules may be located in a single geographic location (for example, within a home or office environment, or a server farm), or may be distributed across multiple geographic locations.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

In the foregoing. detailed description, numerous specific details are set forth by way of examples in order to provide a thorough understanding of the relevant teachings. It will be apparent to persons of ordinary skill, upon reading this description, that various aspects can be practiced without such details. In other instances, well known methods, procedures, components, and/or circuitry have been described at a relatively high-level, without detail, in order to avoid unnecessarily obscuring aspects of the present teachings.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached items and their equivalents. Also, various modifications and changes may be made within the scope of the attached items.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following items to item any and all applications, modifications and variations that fall within the true scope of the present teachings.

Unless otherwise stated, all measurements, values, ratings, positions, magnitudes, sizes, and other specifications that are set forth in this specification, including in the items that follow, are approximate, not exact. They are intended to have a reasonable range that is consistent with the functions to which they relate and with what is customary in the art to which they pertain.

The scope of protection is limited solely by the items and claims set forth herein. That scope is intended and should be interpreted to be as broad as is consistent with the ordinary meaning of the language that is used in the items and claims when interpreted in light of this specification and the prosecution history that follows and to encompass all structural and functional equivalents. Notwithstanding, none of the items or claims are intended to embrace subject matter that fails to satisfy the requirement of Sections 101, 102, or 103 of the Patent Act, nor should they be interpreted in such a way.

Except as stated immediately above, nothing that has been stated or illustrated is intended or should be interpreted to cause a dedication of any component, step, feature, object, benefit, advantage, or equivalent to the public, regardless of whether it is or is not recited in the items.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element. Furthermore, subsequent limitations referring back to "said element" or "the element" performing certain functions signifies that "said element" or "the element" alone or in combination with additional identical elements in the process, method, article or apparatus are capable of performing all of the recited functions.

The Abstract of the Disclosure is provided to allow the reader to quickly ascertain the nature of the technical disclosure. It is submitted with the understanding that it will not be used to interpret or limit the scope or meaning of the items. In addition, in the foregoing Detailed Description, it can be seen that various features are grouped together in various examples for the purpose of streamlining the disclosure. This method of disclosure is not to be interpreted as reflecting an intention that the items require more features than are expressly recited in each item. Rather, as the following items reflect, inventive subject matter lies in less than all features of a single disclosed example. Thus, the following items are hereby incorporated into the Detailed Description, with each item standing on its own as a separately itemed subject matter.

What is claimed is:

1. A diaper changing apparatus for automatically removing a used diaper from a person and placing a new diaper on the person, comprising:

a frame, including a base portion and a head portion located on the base portion;

a backrest located on an upper part of the base portion, wherein the backrest is configured to hold an upper back region of the person, and wherein the backrest is further configured so that a diapering area of the person, that includes a lower back region and upper leg regions of the person, is exposed over an opening in the upper part of the base portion;

a core located to be movable inside the frame; and a controller configured to move the core longitudinally from an initial position, spaced apart from the diapering area of the person, into a first position adjacent to the diapering area of the person, to remove the used diaper from the diapering area of the person when the core is in the first position, to dispose of the removed used diaper in a waste tank, to place the new diaper on the diapering area of the person, and to move the core longitudinally away from the diapering area of the person back to the initial position after the new diaper has been placed on the diapering area of the person.

2. The apparatus of claim 1, wherein the controller is further configured to rotate the core within the frame from the first position, adjacent the diapering area of the person, after the used diaper has been removed, to a second position in which the removed used diaper is disposed in the waste tank, and then rotate the core again into a third position, adjacent the diapering area of the person, in which the new diaper is placed on the diapering area of the person.

3. The apparatus of claim 2, wherein the controller is further configured to operate a first nozzle of the core to wash the diapering area of the person when the core is rotated by the controller into the second position.

4. The apparatus of claim 2, wherein the core includes a diaper removing system configured to remove the diaper, based on control signals from the controller, when the core is moved into the first position by the controller, and a diapering system, including an upper jaw assembly and a lower jaw assembly, configured to place a new diaper on the diapering area of the person, based on control signals from the controller, when the core is rotated by the controller into the third position.

5. The apparatus of claim 4, wherein the core further comprises a mobile sink and a first nozzle to wash the diapering area of the person when the core is rotated by the controller into the second position.

6. The apparatus of claim 5, wherein the waste tank is located within the core, and wherein the controller is configured to operate the diaper removing system to dispose of the removed used diaper in the waste tank when the core is rotated by the controller into the second position.

7. The apparatus of claim 6, wherein the diaper removing system comprises a lower portion, a rotatable upper portion spaced apart from the lower portion, and a gate located adjacent to the waste tank, and wherein the controller is configured to move the lower portion under a back portion of the used diaper while it is on the diapering area of the person while the rotatable upper portion is rotated into contact with a front part of the used diaper, and to move the lower portion and the rotatable upper portion together to remove the diaper from the person by moving the core longitudinally away from the diapering area of the person prior to rotating the core into the second position.

8. The apparatus of claim 7, wherein the controller is further configured to move the lower portion and the rotatable upper portion of the diaper removing system together, after the used diaper has been removed from the diapering area of the person, to rotate the core into the second position and to deposit the removed used diaper through the gate into the waste tank.

9. The apparatus of claim 7, wherein the lower portion of the diaper removing system includes a roughened area configured to stick to the back portion of the used diaper.

10. The apparatus of claim 9, wherein the rotatable upper portion of the diaper removing system includes a roughened area configured to stick to the front portion of the diaper.

11. The apparatus of claim 5, wherein the mobile sink includes second nozzles located in a rim of the mobile sink, wherein the controller is configured to rinse the mobile sink using the second nozzles after the first nozzle is used to wash the diapering area of the person when the controller has rotated the core into the second position.

12. The apparatus of claim 4, wherein the upper jaw assembly includes first and second upper jaw forks, the lower jaw assembly includes first and second lower jaw forks, and the controller is configured to move the first and second lower jaw forks to opposite sides of the diapering area of the person when the core is rotated into the third position and to move the first and second upper jaw forks above an upper portion of the diapering area of the person, and to move the first and second upper jaw forks and the first and second lower jaw forks to attach and seal the new diaper on the person, which new diaper has been placed on the first and second upper jaw forks and the first and second lower jaw forks when the core is in the initial position while the core is spaced apart from the diapering area of the person.

13. The apparatus of claim 4, wherein the core further includes a garbage sealing system located above the waste tank in the core, and wherein the controller is further configured to seal the used diaper in a plastic bag in the waste tank after the diaper is deposited in the waste tank when the core is rotated into the second position by the controller.

14. The apparatus of claim 13, wherein the garbage sealing system comprises a fixed element located above the waste tank and a movable element located above the waste tank and space apart from the fixed element, and wherein the controller is further configured to move the movable element into contact with the fixed element after the diaper has been deposited in the plastic bag in the waste tank and to seal the plastic bag with the used diaper inside.

15. The apparatus of claim 1, wherein the frame further includes a pair of wheels located at a lower end of the base portion of the frame and configured to permit the frame to rotate from a first frame position where the person is in a laying position on the backrest into a second frame position in which the person is sitting on the upper part of the base portion of the frame with their back against the backrest.

16. The apparatus of claim 1, wherein the frame further includes a pair of leg holders located on opposite sides to the head portion of the frame and configured to hold legs of the person on opposite sides of the head portion of the frame when the person is on the backrest.

17. The apparatus of claim 16, wherein the backrest and the pair of leg holders are adjustable to accommodate a size of the person.

18. The apparatus of claim 17, further comprising a belt adjacent to the backrest for holding the upper back region of the person to the backrest while the used diaper is removed and the new diaper is placed on the diapering area.

19. The apparatus of claim 1, wherein the apparatus further includes a protective shield located between the person and a control panel located on the head portion of the frame.

20. The apparatus of claim 1, wherein the controller includes a control panel configured to allow entering commands to the controller and to display information regarding operations of the apparatus.

21. A method of removing a used diaper from a diapering area of a person and placing a new diaper on the person using an apparatus that includes a frame, a backrest to support an upper back region of the person, and a core movable in the frame, the method comprising performing steps of:

placing the new diaper onto a diapering system located on the core;

placing the person on the backrest;

moving the core within the frame from an initial position, spaced apart from a diapering area of the person, to a first position adjacent the diapering area;

removing the used diaper from the diapering area using a diaper removing system of the core;

depositing the removed used diaper into a waste tank after it has been removed from the person by the diaper removing system of the core;

moving the diapering system of the core into a position adjacent the diapering area of the person;

placing the new diaper, held by the diapering system, onto the diapering area of the person; and moving the core back to the initial position after the new diaper has been placed on the diapering area of the person.

22. The method of claim 21, wherein the steps of moving the core within the frame from the initial position to the first position adjacent the diapering area, removing the used diaper using the diaper removing system of the core, depositing the removed used diaper into the waste tank after it has been removed from the person by the diaper removing system of the core, moving the diapering system of the core into a position adjacent the diapering area of the person, placing the new diaper onto the diapering area of the person, and moving the core back to the initial position after the new diaper has been placed on the diapering area of the person are performed by an electronic controller.

23. The method of claim 22, wherein the method further comprises the person or another person opens a pair of diaper tapes which hold the used diaper on the diapering area prior to the used diaper being removed by the diaper removing system of the core.

24. The method of claim 22, wherein the method further comprises rotating the core, in response to control signals from the electronic controller, within the frame from the first position, adjacent the diapering area of the person, after the used diaper has been removed, to a second position in which the removed used diaper is disposed in the waste tank, and then rotating the core again into a third position, adjacent the diapering area of the person, in which the new diaper is placed on the diapering area of the person.

25. The method of claim 24, further comprising operating a first nozzle of the core to wash the diapering area of the person when the core is rotated by the electronic controller into the second position.

26. The method of claim 24, wherein the diapering system includes an upper jaw assembly and a lower jaw assembly configured to place a new diaper on the diapering area of the person, based on control signals from the electronic controller, when the core is rotated by the electronic controller into the third position.

27. The method of claim 26, wherein the upper jaw assembly includes first and second upper jaw forks, the lower jaw assembly includes first and second lower jaw forks, and the electronic controller is configured to move the first and second lower jaw forks to opposite sides of the diapering area of the person when the core is rotated into the third position and to move the first and second upper jaw forks above an upper portion of the diapering area of the person, and to move the first and second upper jaw forks and the first and second lower jaw forks to attach and seal the new diaper on the person, which new diaper has been placed on the first and second upper jaw forks and the first and second lower jaw forks when the core is in the initial position while the core is spaced apart from the diapering area of the person.

28. The method of claim 24, wherein the diaper removing system comprises a lower portion, a rotatable upper portion spaced apart from the lower portion, and a gate located adjacent to the waste tank, and wherein the electronic controller is configured to move the lower portion under a back portion of the used diaper while it is on the diapering area of the person while the rotatable upper portion is rotated into contact with a front part of the used diaper, and to move the lower portion and the rotatable upper portion together to remove the diaper from the person by moving the core longitudinally away from the diapering area of the person prior to rotating the core into the second position.

29. The method of claim 28, wherein the electronic controller is further configured to move the lower portion and the rotatable upper portion of the diaper removing system together, after the used diaper has been removed from the diapering area of the person, to rotate the core into the second position and to deposit the removed used diaper through the gate into the waste tank.

30. The method of claim 24, wherein the core further includes a garbage sealing system located above the waste tank in the core, and wherein the electronic controller is further configured to seal the used diaper in a plastic bag in the waste tank after the diaper is deposited in the waste tank when the core is rotated into the second position by the electronic controller.

* * * * *